US006584691B1

(12) United States Patent
Gerasimov et al.

(10) Patent No.: US 6,584,691 B1
(45) Date of Patent: Jul. 1, 2003

(54) ELECTRIC SHAVER HAVING ORBITALLY MOVING BLADES

(75) Inventors: Vladimir Gerasimov, West Bloomfield, MI (US); Gafur Zainiev, West Bloomfield, MI (US); Ivan Gerasimov, West Bloomfield, MI (US); Inlik Zainiev, West Bloomfield, MI (US); Boris Zlotin, West Bloomfield, MI (US)

(73) Assignee: Technology Innovations, LLC, West Henrietta, NY (US)

( * ) Notice: Subject to any disclaimer, the term of this patent is extended or adjusted under 35 U.S.C. 154(b) by 158 days.

(21) Appl. No.: 09/679,749

(22) Filed: Oct. 5, 2000

Related U.S. Application Data

(60) Provisional application No. 60/158,492, filed on Oct. 8, 1999.

(51) Int. Cl.[7] ..... B26B 19/14

(52) U.S. Cl. ..... 30/43.6; 30/43.3; 30/43.5; 30/346.51

(58) Field of Search ..... 30/42, 43, 43.3, 30/43.4, 43.5, 43.6, 346.51, 34.2

(56) References Cited

U.S. PATENT DOCUMENTS

| | | | | | |
|---|---|---|---|---|---|
| 2,283,834 | A | * | 5/1942 | Van Dam et al. | 30/43 |
| 2,396,181 | A | * | 3/1946 | Kerwer | 30/43.5 |
| 2,965,966 | A | * | 12/1960 | Jacobs | 30/43.5 |
| 3,129,507 | A | * | 4/1964 | Tweedale | 30/43.6 |
| 4,038,747 | A | * | 8/1977 | Upton | 30/43.3 |
| 4,180,906 | A | * | 1/1980 | May | 30/346.51 |
| 4,301,593 | A | * | 11/1981 | May | 30/43.3 |
| 4,475,285 | A | * | 10/1984 | Hara et al. | 30/43.6 |
| 5,625,950 | A | * | 5/1997 | Sterk et al. | 30/43.6 |
| 5,983,501 | A | * | 11/1999 | Izumi | 30/43.5 |
| 6,212,776 | B1 | * | 4/2001 | Izumi et al. | 30/43.4 |

FOREIGN PATENT DOCUMENTS

| | | | |
|---|---|---|---|
| FR | 2 531 898 | * | 2/1984 |
| JP | 52-116360 | * | 9/1977 |

* cited by examiner

*Primary Examiner*—Hwei-Siu Payer
(74) *Attorney, Agent, or Firm*—Brian B. Shaw, Esq.; Roger Aceto, Esq.; Harter, Secrest & Emery LLP

(57) ABSTRACT

An electric shaver, and in particular an electric shaver wherein are included blades which while rotating around their own centers also orbit around another axis, thus providing that the blades sweep a large area.

43 Claims, 22 Drawing Sheets

134
164
166
110
190
132
154
163
162
144
142
160
140
104
108
102
103
136
130
11
12

FIG.14
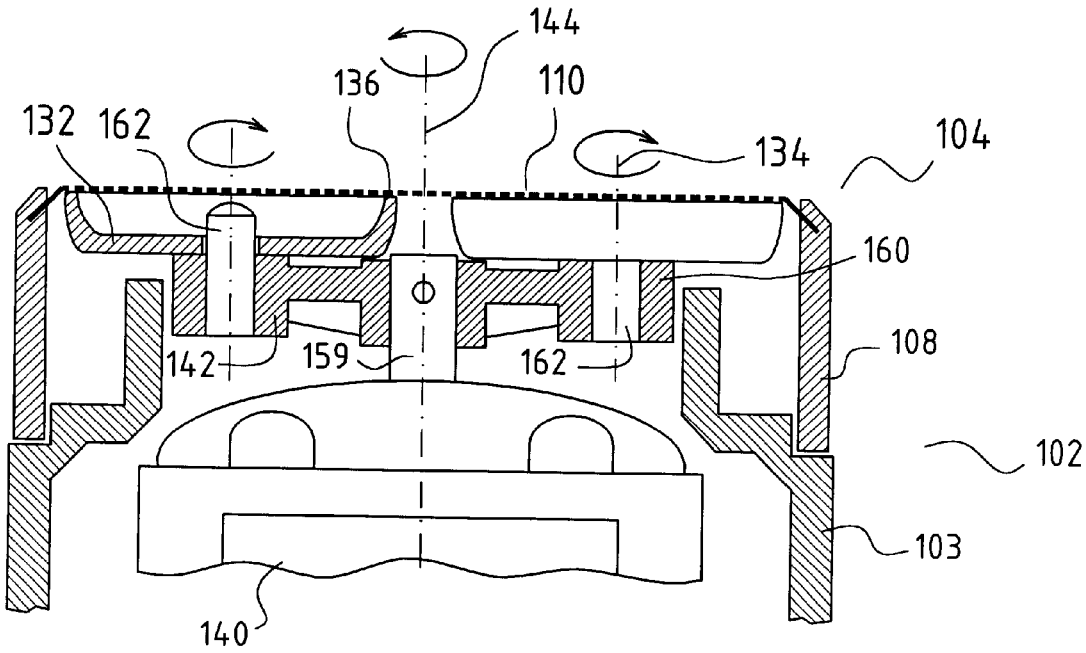
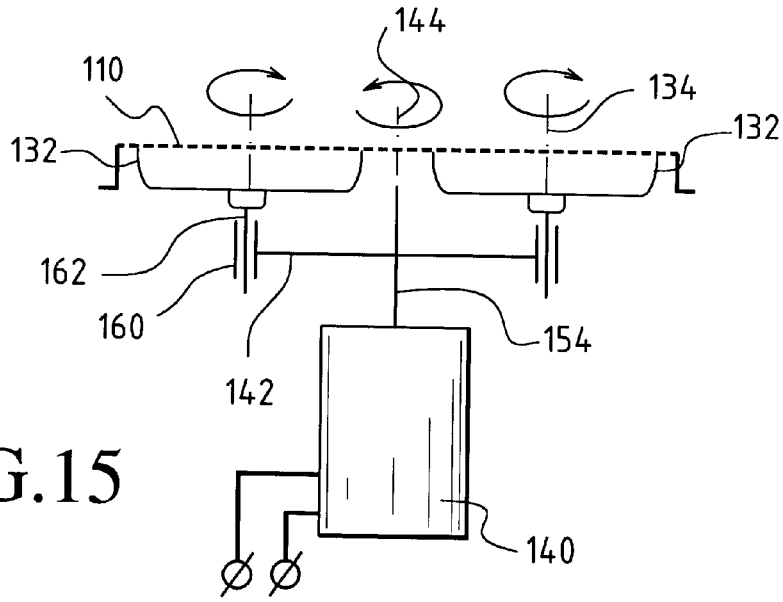
FIG.15

ELECTRIC SHAVER HAVING ORBITALLY MOVING BLADES

This application claims the benefit of U.S. Provisional Application No. 60/158,492, filed Oct. 8, 1999.

FILED OF THE INVENTION

This invention relates to shavers, and in particular to electric shavers including blades that, while rotating around their own centers, also orbit around another axis, thus sweeping a large area.

BACKGROUND OF THE INVENTION

It is known that facial hair does not grow perpendicularly. The typical angle between the axis of a hair and the surface of a face is between 30 and 60 degrees. To achieve the cleanest shaving, it is therefore necessary to move a shaver in different directions. Hair is best cut exactly against the direction of growth, which is substantially random. Therefore, any linear movement of a blade will not give the best cut for each and every hair, and an average result is achieved after shaving with modern razor or electric shaver. Some hairs are cut in the best direction and some are not. Typically, modern electric shavers have blades that move in a simple rotary path or linearly in a reciprocating manner. At a given location on a razor head, the movement of a blade is always in the same direction, or, in the best case, in two opposite directions. Although a user can compensate by manually varying the shaving pattern, this is a largely habitual action that does not necessarily provide a satisfactory remedy. Further, the actual cutting area on a typical shaver head is relatively small, and some areas of the face may not have as much exposure to the blades as other areas. There is a need to provide a shaving system that addresses these disadvantages.

Furthermore, experience with straight razors indicates that skin stretching leads to cleaner shaving. Stretching the skin makes it "thinner" and a greater length of hair is pushed out of the skin. Once stretched skin relaxes after being shaved with a straight razor, the remaining stub recedes beneath the surface of the skin and becomes effectively invisible. By contrast, after being shaved with a current electric shaver, the best result nevertheless leaves a hair stub as high as thickness of screen. Stretching of the skin in the process of electric shaver shaving would be advantageous.

BRIEF DESCRIPTION OF THE INVENTION

The invention provides an electric shaver in which a much greater area of the shaving head than hitherto is an active shaving area.

It further provides that the movement of the blades follows a more complex path than hitherto.

It further provides that adjoining blades are configured and driven so that they sweep overlapping areas. All of these features make it more likely that a blade will meet an individual hair from an appropriate direction.

The invention further provides an electric shaver that can stretch the skin, thus providing a cleaner shave than heretofore. The skin may be stretched by contouring the shaving head appropriately, or by providing a reduced air pressure within the shaving head.

Further, the invention provides that the shaving head may optionally be structured to replace a conventional shaving head on an existing shaver.

Finally, the invention provides that a shaver may be separated from its source of power. In such a divided system, a shaving head may be coupled to a stationary source of power such as might be provided in a car, in private quarters, or in a public washroom in a hotel, a restaurant, an office building, an aircraft, a train, an ocean liner or other building or vehicle. Such a shaving head can be inexpensive and intended for a small number of uses.

BRIEF DESCRIPTION OF THE DRAWINGS

FIG. 14 is a front elevation in partial section of a fifth embodiment of the shaver mechanism;

FIG. 15 a schematic front elevation of the fifth embodiment of the shaver mechanism;

DETAILED DESCRIPTION OF THE INVENTION

Figure 1:
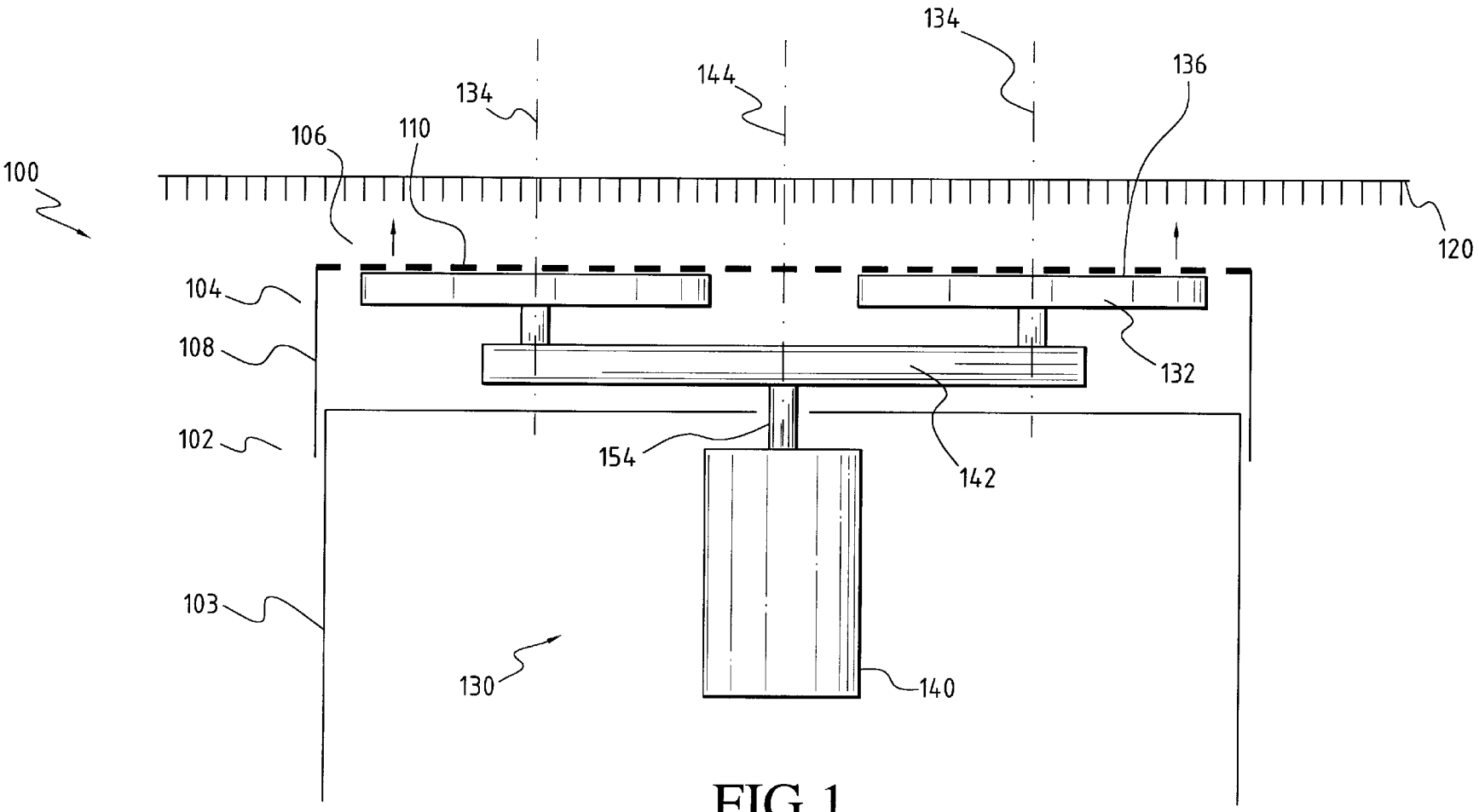
FIG. 1 is a partial schematic of a shaving apparatus, including a housing, a shaver head, and a shaver mechanism.

Referring now to the drawings, FIG. 1 schematically represents a shaver 100 having a housing 102 which includes a body 103 and a shaving head 104, the head 104 having a contact area 106 which can come into contact with a surface to be shaved such as a skin 120. A shaver mechanism 130 is defined as including a motor 140 operably connected to one or more blades 132. The body 103 contains a portion of the mechanism 130, including the motor 140, and the head 104 includes another portion and in particular the blades 132. Some portions of the transmission system are selectably disposed in either the body 103 or the head 104. The blades 132 are typically held within a wall 108 of the shaving head 104 by a retaining mechanism comparable with those in prior art shavers. Therefore, the retaining mechanism will not be described further.

The shaving head 104 includes a screen 110 with multiple openings; the outside of the screen contacts the skin 120 and the inside is contacted by the blades 132 at knife-edges 136. The screen 110 effectively occupies the entire contact area 106. Hairs on the skin 120 protrude through the screen to be cut when the shaver 100 is actuated.

Figure 2:
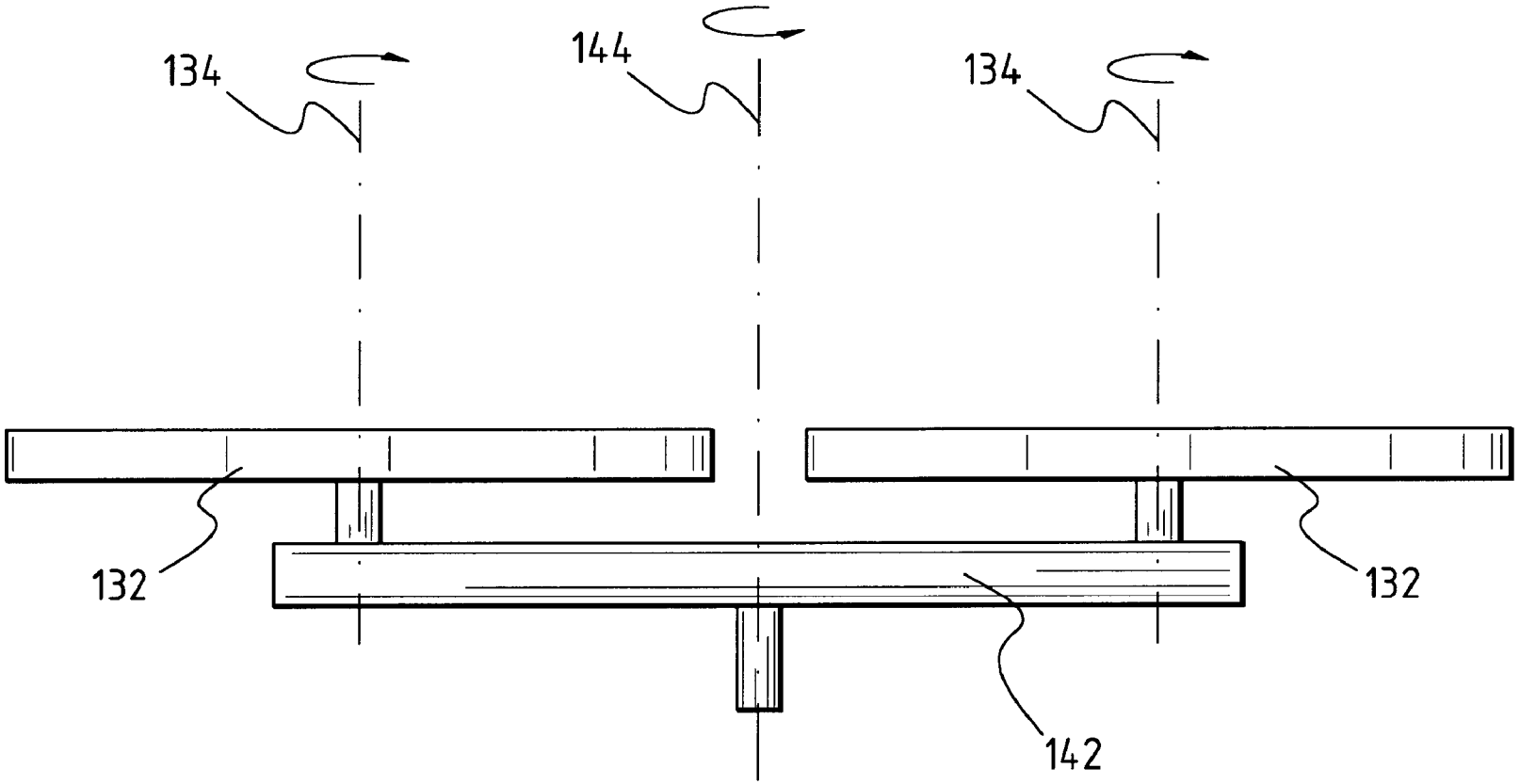
FIG. 2 is a schematic of a portion of a shaver mechanism wherein rotatable blades can also follow a circular orbit around a primary axis.
Figure 3:
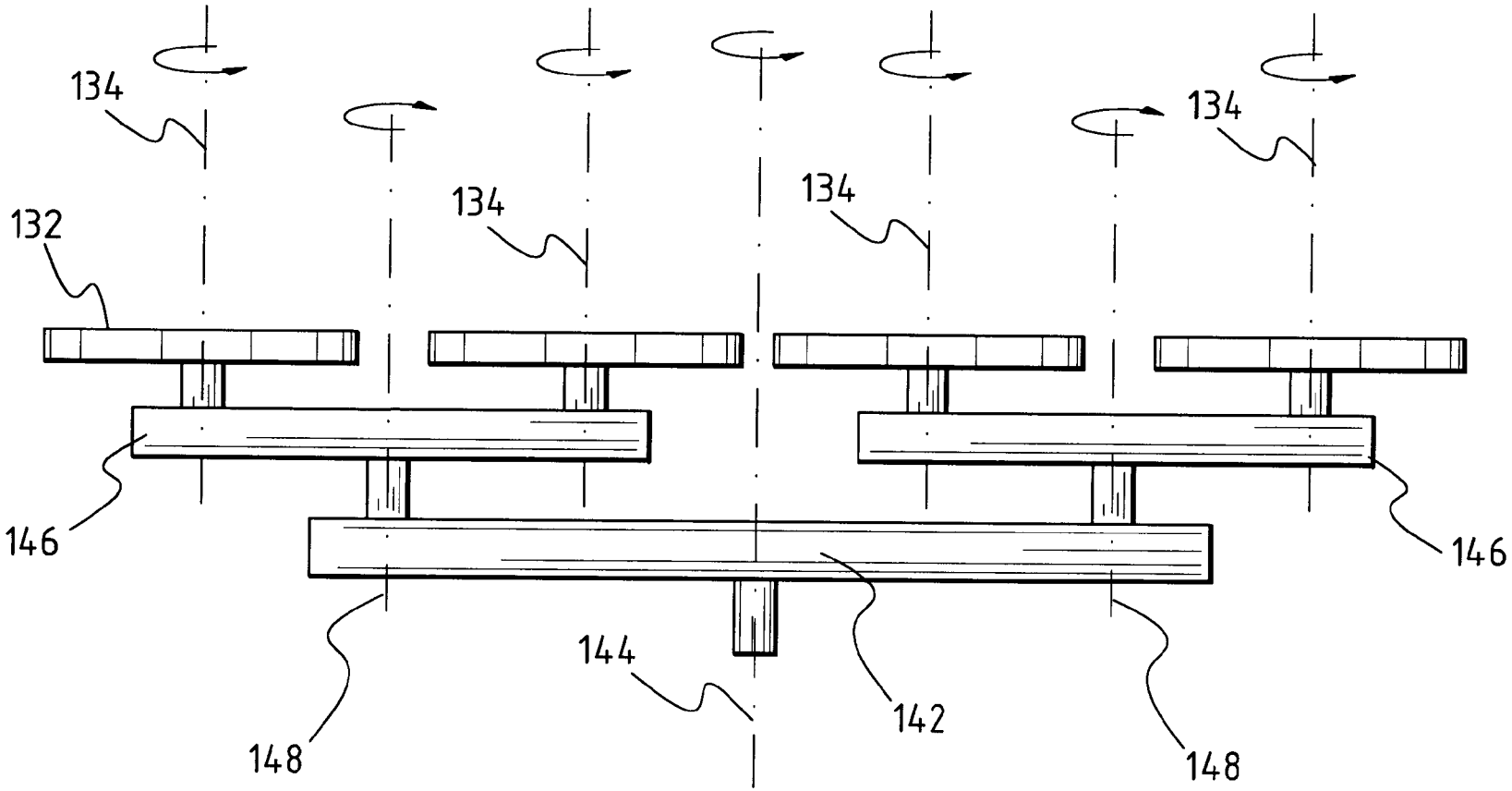
FIG. 3 is a schematic of a portion of a shaver mechanism wherein rotatable blades can also follow a circular orbit around a secondary axis which itself follows a circular orbit around the primary axis.

Most of the embodiments to be described below have in common a primary drive motor 140, a carrier or primary carrier 142 which is rotatable about a primary axis 144, and a plurality of blades 132, as shown schematically in FIG. 2. In some cases, a secondary carrier 146 is present, as shown in FIG. 3. The various shaving assemblies 130 can be viewed as being constructed in a hierarchical manner, having a series of axes which has at least one member and which always includes the primary axis. Unless otherwise stated, when no secondary carrier is present, the primary carrier 142 has thereon rotatable blades 132 that are typically disposed symmetrically about the primary axis 144. Each blade 132 is centered on a corresponding center line 134.

Secondary carriers 146, when present, are placed on the primary carrier 142, and are rotatable about corresponding secondary axes 148 which are typically symmetrically disposed about the primary axis 144. Each secondary carrier 146 has thereon rotatable blades 132 that are disposed symmetrically about the secondary axis 148, each blade 132 being centered on the corresponding center line 134.

It is possible that more than one primary carrier may be present, each rotating about its own primary axis. What differentiates any primary carrier from a secondary carrier is that its axis of rotation does not revolve about the primary axis of another carrier.

Figure 4:
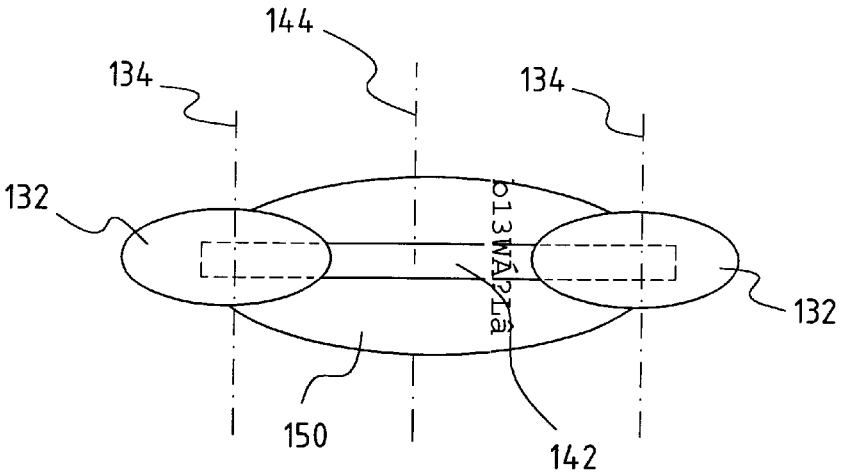
FIG. 4 is a schematic showing a rotation area of a carrier.

To summarize, then, the primary axis 144 always represents the axis of rotation of the primary carrier 142, the secondary axis 148 always represents the axis of rotation of the secondary carrier 146, and the center line 134 always represents the axis of rotation of the blade 132. When rotated, the primary carrier 142 defines a corresponding rotation area 150, as shown schematically in FIG. 4.

Figure 5:
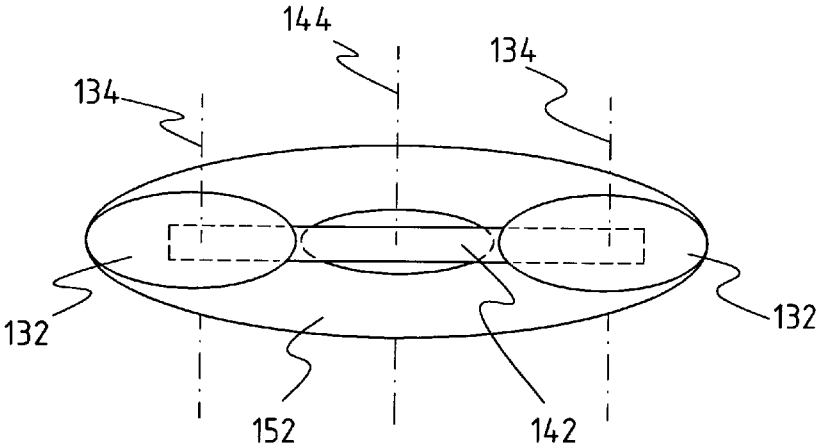
FIG. 5 is a schematic showing a sweep of two similar blades symmetrically disposed on a carrier.
Figure 6:
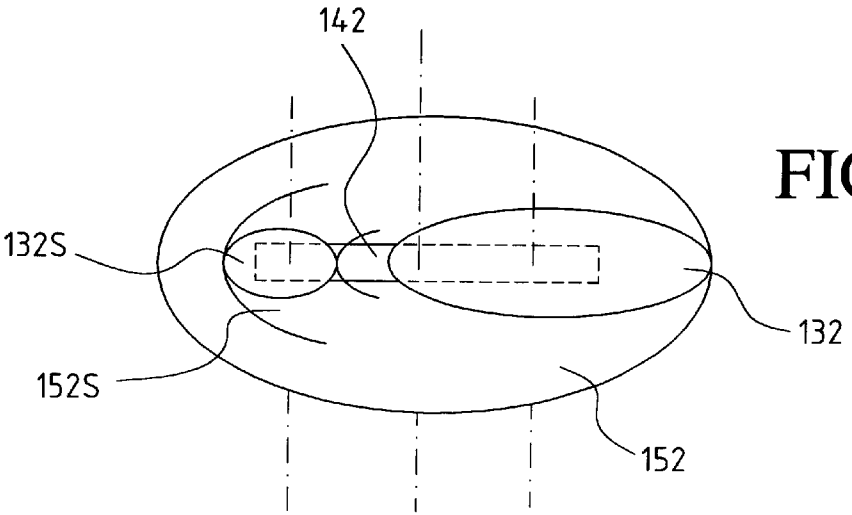
FIG. 6 is a schematic showing a sweep of two dissimilar blades on the carrier.

The total movement of the blade 132, about its center line 134 and around the primary axis 144 defines the sweep 152 of the blade. Identical blades spaced equally and symmetrically on a given carrier would produce a combined sweep identical to the sweep of each individual blade, as indicated in FIG. 5. Differently configured blades on the same carrier may have different sweeps; the combined sweep would be usually be defined by the sweep having the larger area, since it would typically encompass the area of the smaller sweep. This is indicated schematically in FIG. 6, wherein the smaller blade has the label 132S and its sweep has the corresponding label 152S.

Similar considerations would apply if a secondary carrier 146 were present, the resultant sweep areas being defined by a combination of the movements of the primary carrier and the secondary carrier and the rotation of the blades.

Some embodiments have more than one motor, in which case the primary motor 140 is the motor that drives the primary carrier 142. In the schematic of FIG. 1, the primary motor 140 is shown with a drive axle 154 coinciding with the primary axis 144. This will not occur in some embodiments. Even though the primary carrier 142 is always driven by the primary motor 140, the relationship between them need not be coaxial; in some instances the drive axle 154 is linearly or angularly spaced apart from the primary axis 144. Some embodiments have a single motor operably connected with a plurality of primary carriers.

Figure 7:
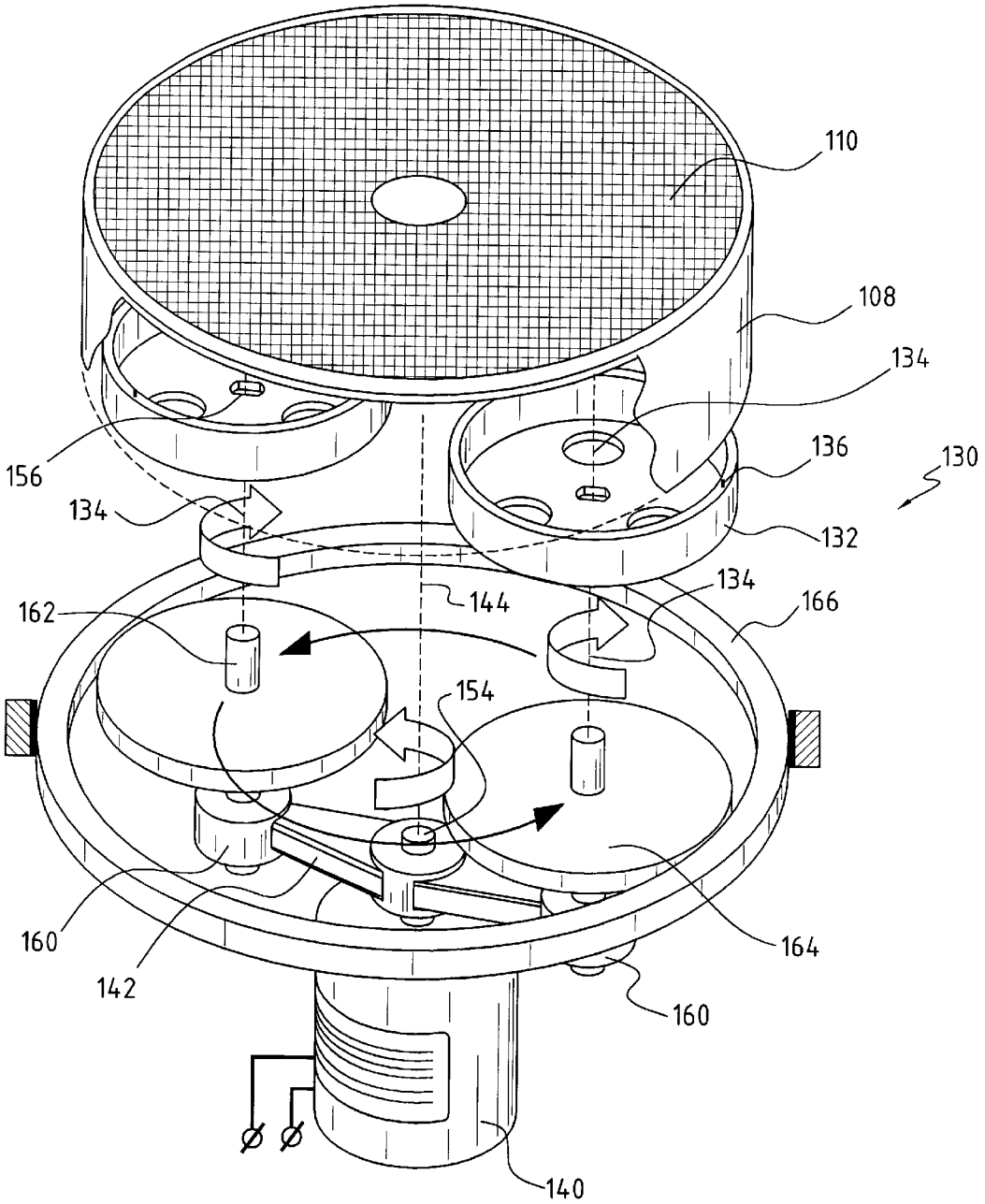
FIG. 7 is an exploded perspective view of a first embodiment of the shaver mechanism.

FIG. 7 shows a first embodiment of the mechanism 130, including the primary motor 140. The axle 154 of the primary motor 140 can rotate about the primary axis 144.

The shaving assembly 130 includes the blade 132 having at its center an elongate hole 156. The carrier 142 is preferably substantially linear or triangular, to provide for carrying at its extremities two or three blades 132 respectively. The carrier is removably secured at its center to the drive axle 154.

At the extremities of the carrier 142 are bearings 160 in which are mounted spindles 162 that can rotate about the corresponding center lines 134. On each spindle 162 is fixedly mounted a gear wheel 164, which therefore is also rotatable around the center line 134.

A stationary gear ring 166 having teeth around its interior perimeter is sized to encompass and engage with the gear wheels 164. The gear ring 166 may optionally be secured by the retaining mechanism to the interior of the housing 102, or it may be integrally molded thereto. The blade 132 has an elongate hole 156 at its center and can removably engage with the corresponding spindle 162 spindle which has a corresponding elongate portion 163, so that the blade 132 can only rotate in concert with the spindle 162. This could also be effected by other non-circular corresponding profiles such as squares or star shapes.

Each blade 132 has a knife-edge 136 around its uppermost extremity. The screen 110 is affixed around its perimeter to the wall 108 of the shaver head 104, so that the knife edges 136 contact the screen 110.

When the primary motor 140 is powered to actuate the shaver 100, the rotation of the axle 154 causes the carrier 142 to rotate about the primary axis 144, in turn causing the bearings 160 to revolve around the primary axis 144. Since the gear wheels 164 are engaged with the gear ring 166, they rotate about the center lines 134 simultaneously with the center lines 134 revolving about the primary axis 144. The blades 132 are operably connected with the gear wheels 164, and therefore also rotate about the center lines 132 while in contact with the screen 110. Thus, the rotating knife-edges 136 sweep around the screen 110 in a path whose width corresponds to the maximum blade diameter, the total area of the path representing a much larger fraction of the contact area 106 than in prior art shavers. This sweep provides that a much larger portion of the skin 120 can be shaved than in prior art, for a given exposure to the contact area 106.

For a given rotational speed of the carrier 142, the rotational speed of the blades is determined by the gear ratio between the gear ring 166 and the gear wheels 164, which can be selectably configured accordingly. For geometric reasons, gear ratios less than 2:1 for a two-blade system and less than 2.8:1 for a three-blade system are precluded. A ratio of about 5:1 would be close to an upper limit beyond which a higher rotational speed would cost an unacceptable loss of mechanical advantage.

Figure 8:
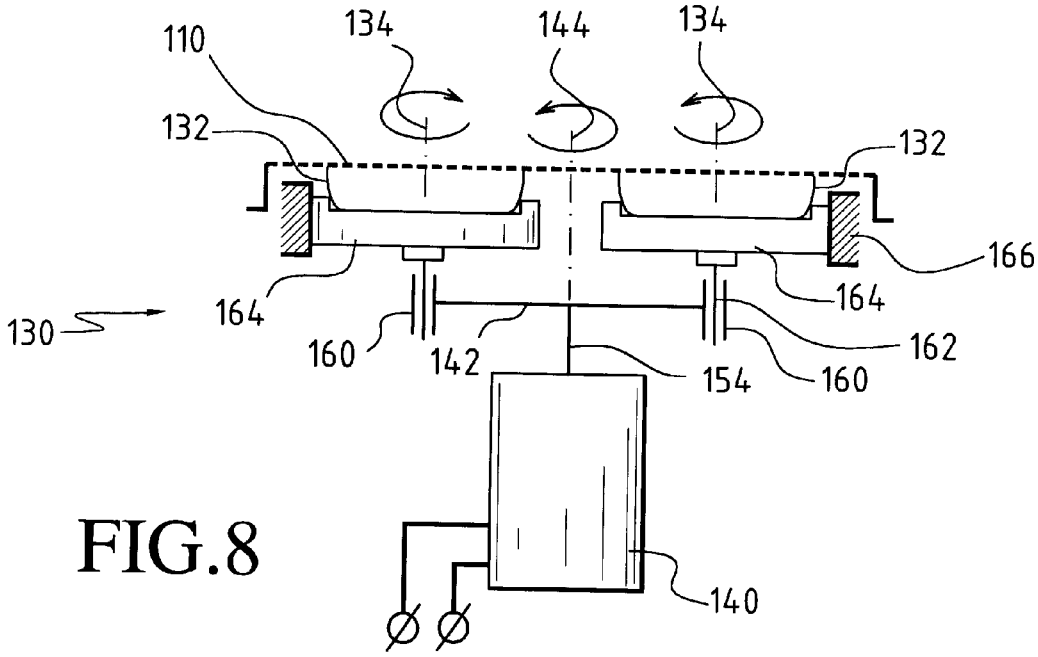
FIG. 8 is a schematic side elevation of a second embodiment of the shaver mechanism.

In a second embodiment shown in FIG. 8, each gear wheel 164 is sized and shaped so that the corresponding blade 132 can nest and be secured therein in such a way that it can only rotate in concert with the gear ring 166. This embodiment provides for a more compact shaver mechanism than in the first embodiment, although it limits the choice of gear ratios.

Figure 9:
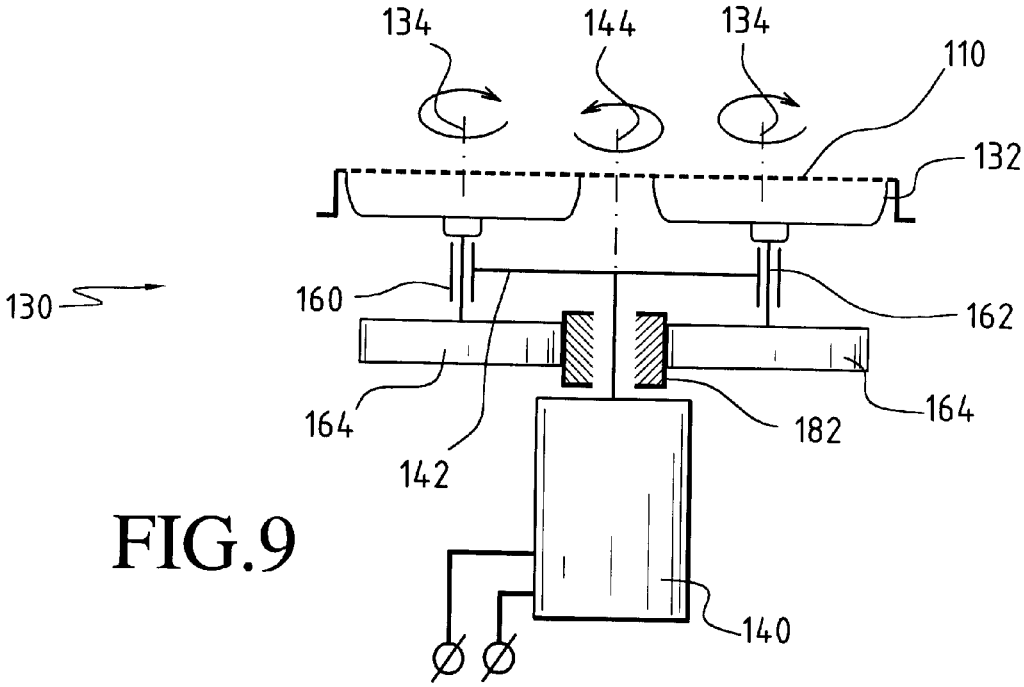
FIG. 9 is a schematic side elevation of a third embodiment of the mechanism.
Figures 10, 11, 12, 13:
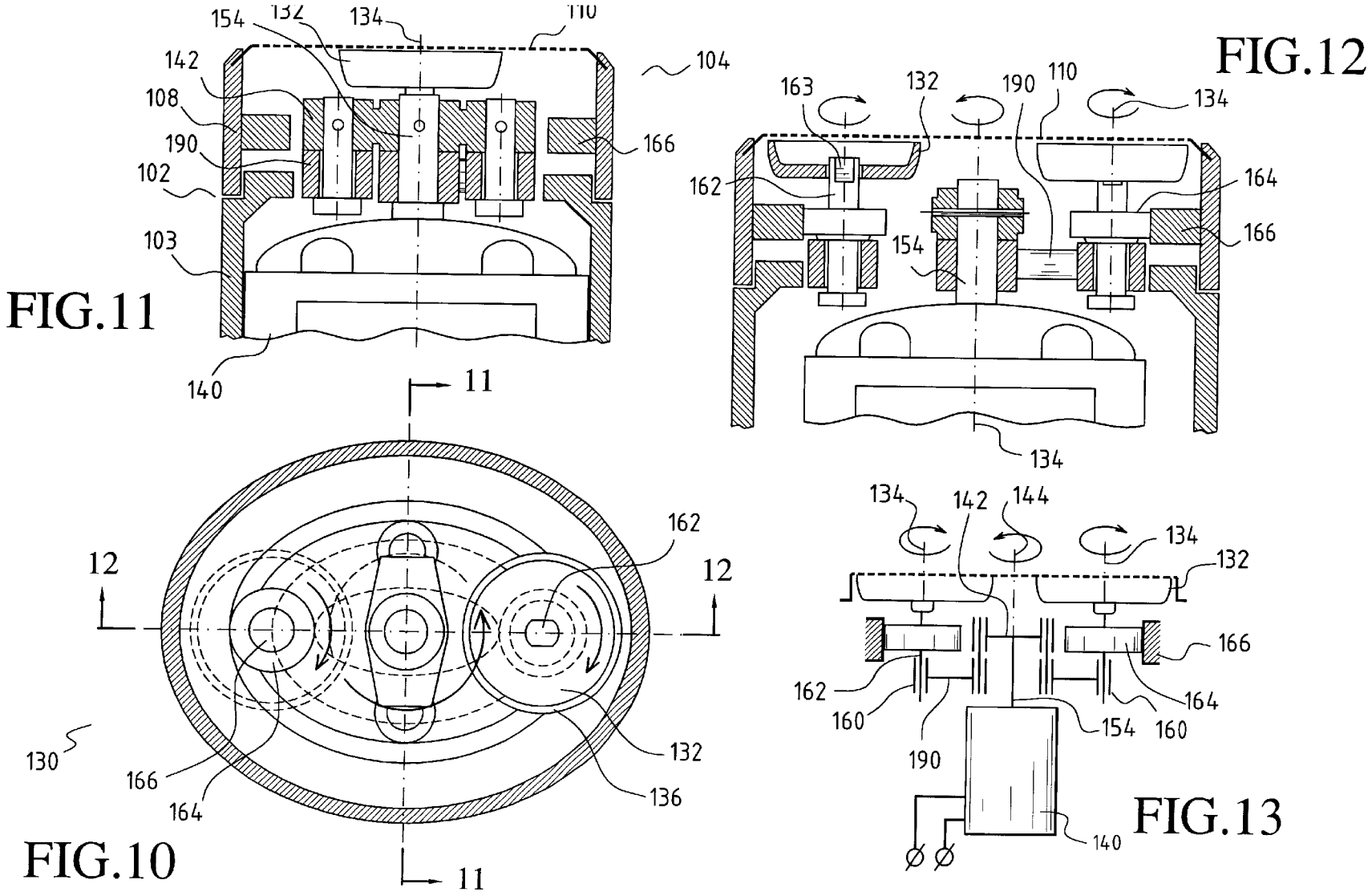
FIG. 10 is a plan view of a fourth embodiment of the shaver mechanism.
FIG. 11 is an end elevation of the embodiment shown in FIG. 10, viewed in partial section along 11—11.
FIG. 12 is a front elevation of the embodiment shown in FIG. 10, viewed in partial section along 12—12.
FIG. 13 is a schematic front elevation of the fourth embodiment of the shaver mechanism.

In a third embodiment shown in FIG. 9, the gear wheels 164 engage with the outside of a stationary central gear 182, which substitutes for the gear ring 166. Typically, the central gear 182 is fixedly mounted to the body 103 (omitted from FIG. 9 for simplicity) around the drive axle 154, and has a central opening to provide clearance therefor.

In a fourth embodiment, illustrated in FIGS. 10, 11, 12 and 13, the gear wheels 164 engage with the gear ring 166, but they are not mounted directly to the carrier 142. Instead, each gear wheel 164 is mounted on a far extremity of a swing arm 190. Each swing arm in turn has a near extremity pivotally attached to an extremity of the carrier 142, so that the arm 190 can pivot in a plane that is perpendicular to the primary axis 144. When the primary motor 140 is energized, the rotation of the carrier 142 causes the far extremity of arm 190 to be urged outward by centrifugal force until the gear wheel 164 is engaged with the gear ring 166. This embodiment provides the advantage that the gear ring 166 need not be circular. It can have any closed smoothly varying shape such as an ellipse, the blades 132 consequently following a similarly shaped orbit. This allows the creation of shaving heads 104 in a variety of artistic and creative shapes.

In the foregoing embodiments, the rotational speeds of the carrier around the primary axis 144 and the blades 132 about their center lines 134 cannot vary independently of each other, since they are predetermined by gear ratios. In a fifth embodiment illustrated in FIGS. 14 and 15, gears are absent from the shaving head, and the blades 132 rotate somewhat independently. As the carrier 142 causes the blades 132 to describe an orbit around the primary axis 144, frictional forces between each of the blades 132 and the screen 110 cause the blade 132 to rotate around its corresponding center line 134. Generally, however, as the carrier speed increases, so too does the blade rotation speed.

Figure 16:
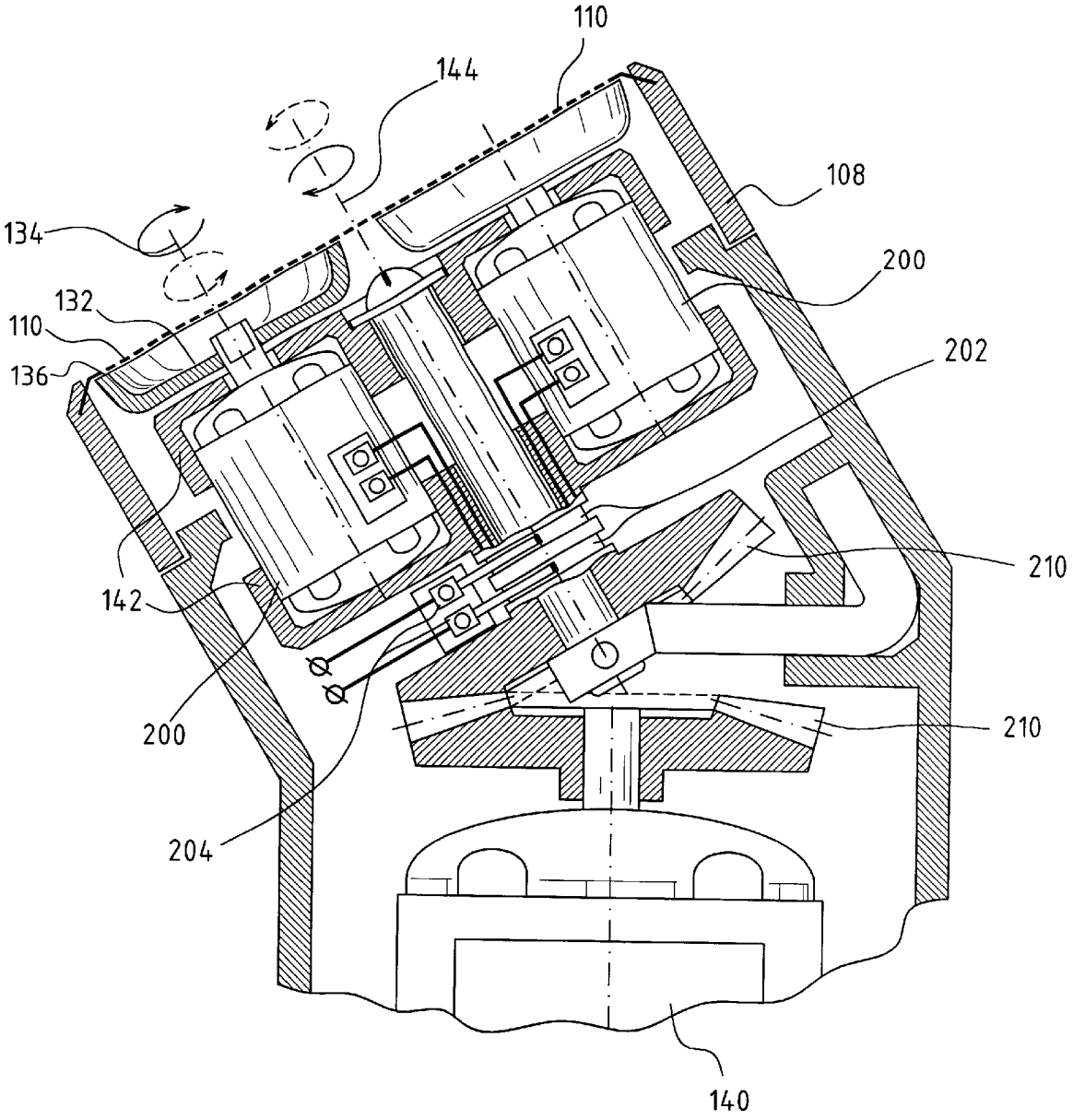
FIG. 16 is an end elevation in partial section of a sixth embodiment of the shaver mechanism.

Further embodiments provide that the rotational speed of the carrier 142 about the primary axis 144 and of the blades 132 about their center lines 134 can be controlled fully independently, being driven by separate motors, each having its own control. In a sixth embodiment, shown in FIG. 16, a secondary motor 200 corresponding to each blade is fixedly mounted to the carrier 142, the secondary motor 200 being disposed coaxially with the appropriate center line 134 and being coupled directly with the spindle 162. The secondary motor 200 is electrically connected with contact rings 202, which slidingly engage with corresponding contacts 204, so providing that the motor remains energized as it rotates. Optionally, the primary motor 140 can directly drive the carrier 142 as in previous embodiments. Or it may be operably connected to the primary motor 140 by cooperating bevel gears 210, providing an angular offset between the drive axle 154 and the primary axis 144, as in FIG. 16.

Figure 17:
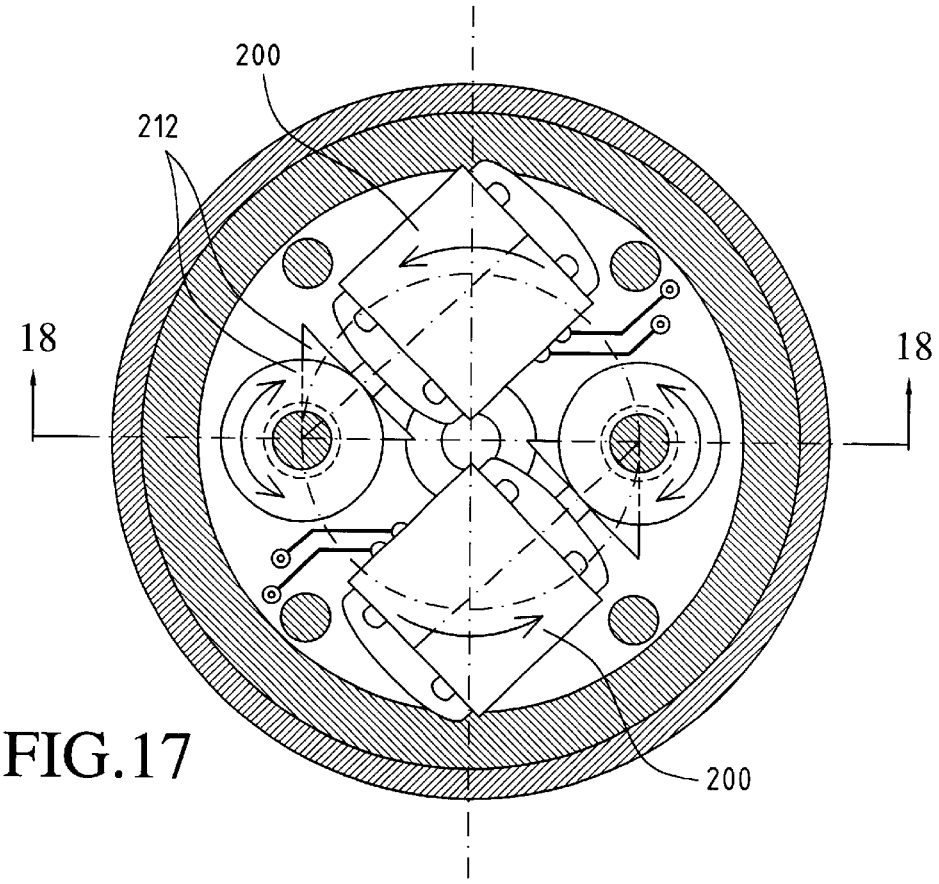
FIG. 17 is a plan view of a seventh embodiment of the shaver mechanism.
Figure 18:
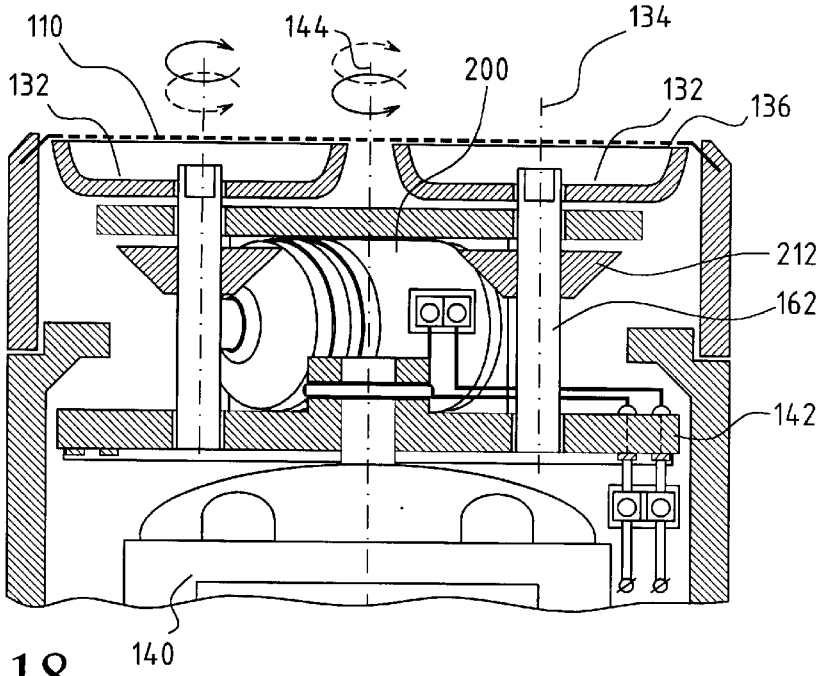
FIG. 18 is a front elevation of the seventh embodiment of the shaver mechanism, viewed in partial section along 18—18.

In a seventh embodiment, shown in FIGS. 17 and 18, each secondary motor 200 is disposed perpendicularly to the corresponding center line 134, being operably coupled with the spindle 162 through cooperating conical gears 212. The primary motor 140 directly drives the carrier as in previous embodiments.

Figure 19:
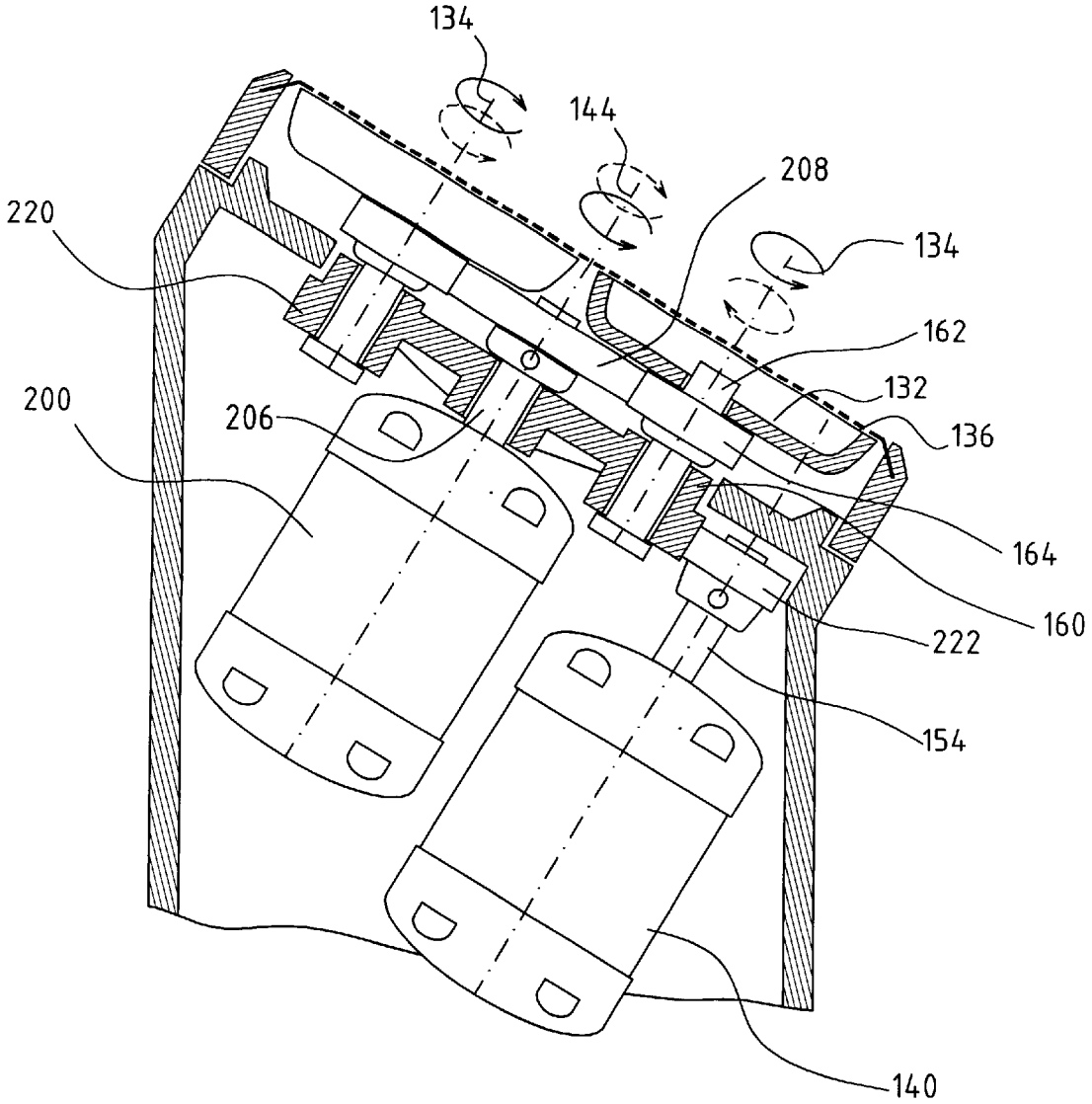
FIG. 19 is an end elevation in partial section of an eighth embodiment of the shaver mechanism.

In an eighth embodiment, shown in FIG. 19, a carrier gear 220 has a circular shape and has gear teeth (not shown) around the outside. It effectively combines in a single member the functions of the carrier 142 and the gear wheel 164. In this embodiment, the primary motor 140, which causes the carrier gear 220 to rotate, is offset to one side. The drive axle 154 of the primary motor 140 has a fixedly attached cog 222 that engages with the carrier gear 220. The secondary motor 200 is aligned with the primary axis 144 and has a drive shaft 206 which passes through the center of the carrier gear 220, such that the latter can rotate independently of the drive shaft 206. Beyond the carrier gear 220, the drive shaft 206 is connected with a drive gear 208.

Symmetrically spaced at extremities of the carrier gear 220, the bearings 160 have mounted therein the spindles 162, on each of it fixedly mounted the gear wheel 164, which cooperates with the drive gear 208. The gear wheel 164 is coupled with the blade 132, and can cause it to rotate about its corresponding center line 134.

In yet other embodiments of the invention, the blades may be shaped so that while rotated in a common plane, their rotations are synchronized so that the rotational areas of adjoining blades can overlap.

Figure 20:
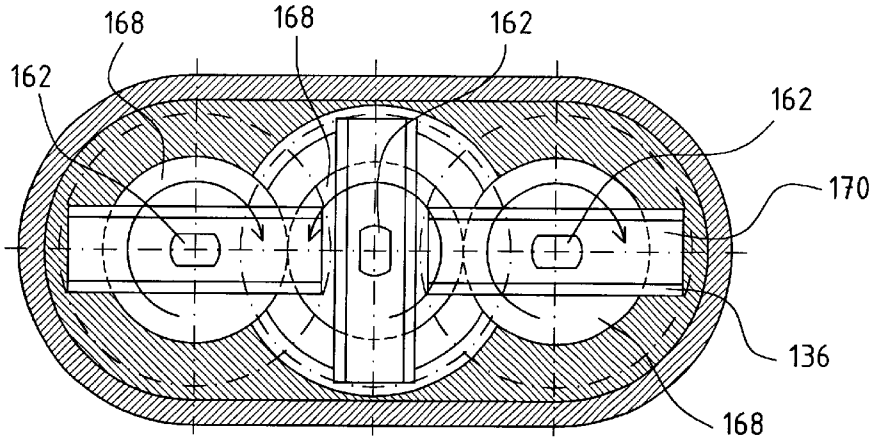
FIG. 20 is a plan view of a ninth embodiment of the shaver mechanism.
Figure 21:
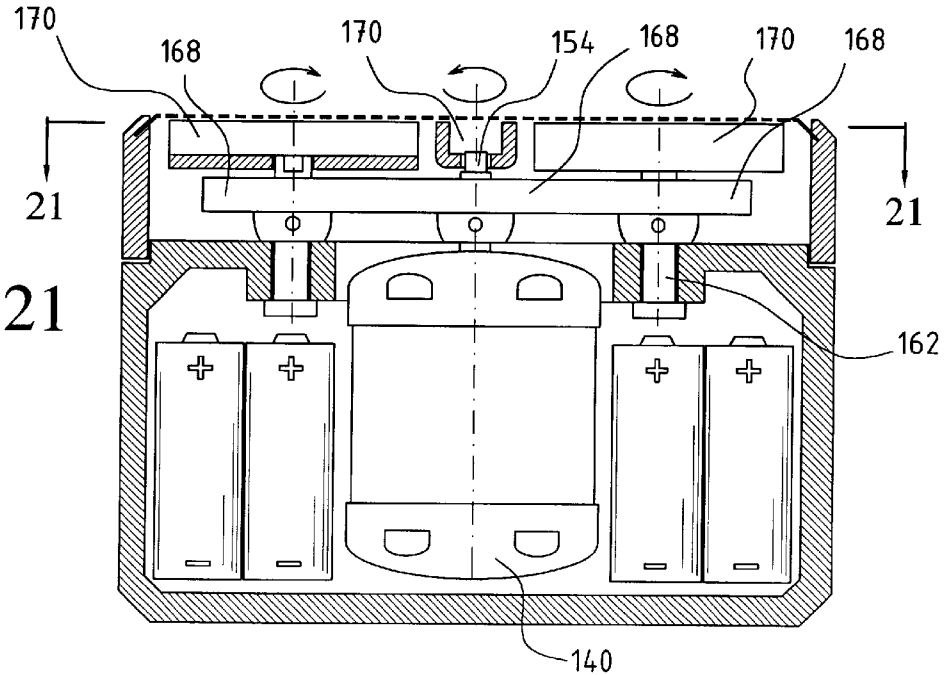
FIG. 21 is a front elevation of the ninth embodiment of the shaver mechanism, viewed in partial section along 21—21

FIGS. 20 and 21 show a ninth embodiment, wherein each of a plurality of cooperating identical gear wheels 168, having their centers in a linear relationship, is coaxially connected to a corresponding elongate blade 170. One of the gear wheels 168 is operably connected to the motor 140, thereby providing that all the gear wheels can rotate at the same rate but in alternating directions when the motor 140 is actuated. The blades 170 are sized and spaced so that when they rotate, they sweep out overlapping areas. Provided that they are compatibly oriented, as in FIG. 20, the rotations of the blades 170 are synchronized so that they do not interfere with each other. In contrast to using circular blades, the elongate blades 170 can sweep a larger area when rotating, since their longest dimension can exceed the distance by which their centers are spaced apart. FIG. 21 shows internal batteries, preferably rechargeable, which are provided to power the motor 140. Such batteries would be an option in the majority of the embodiments described herein.

Figure 23:
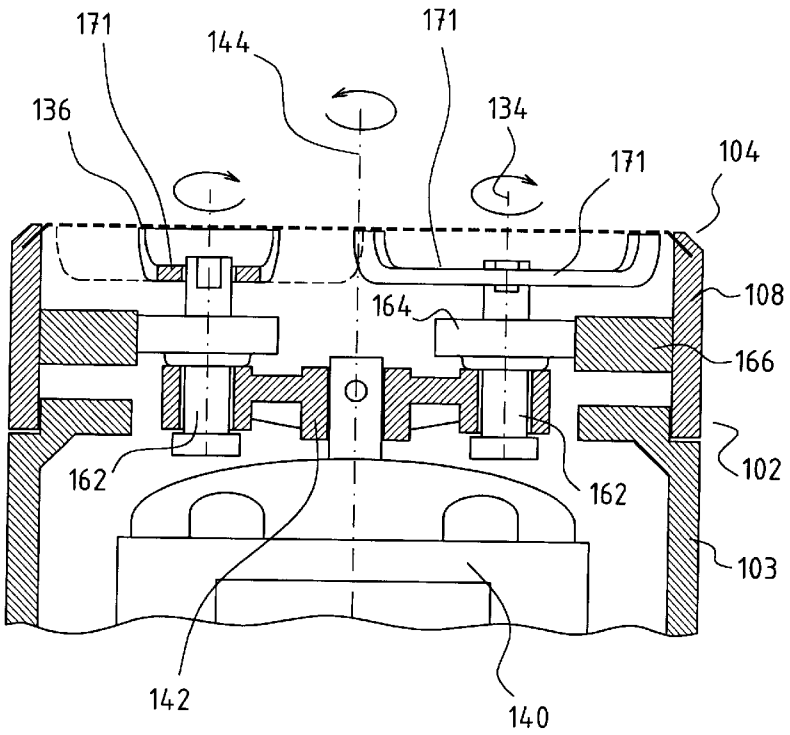
FIG. 23 is a front elevation of the tenth embodiment of the shaver mechanism, viewed in partial section along 23—23.
Figure 22:
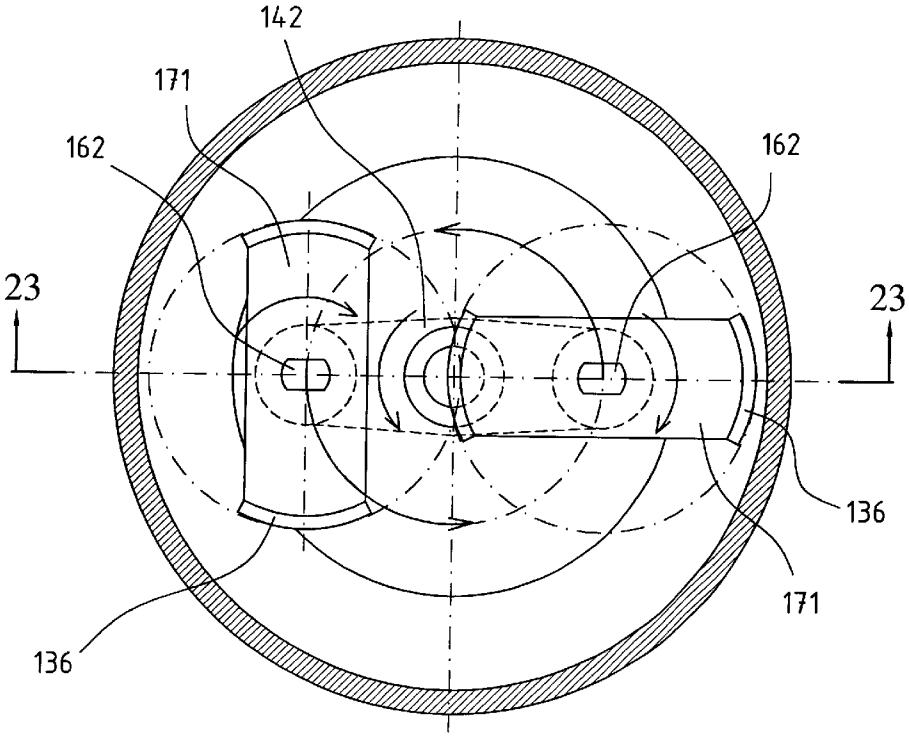
FIG. 22 is a plan view of a tenth embodiment of the shaver mechanism.
Figure 24:
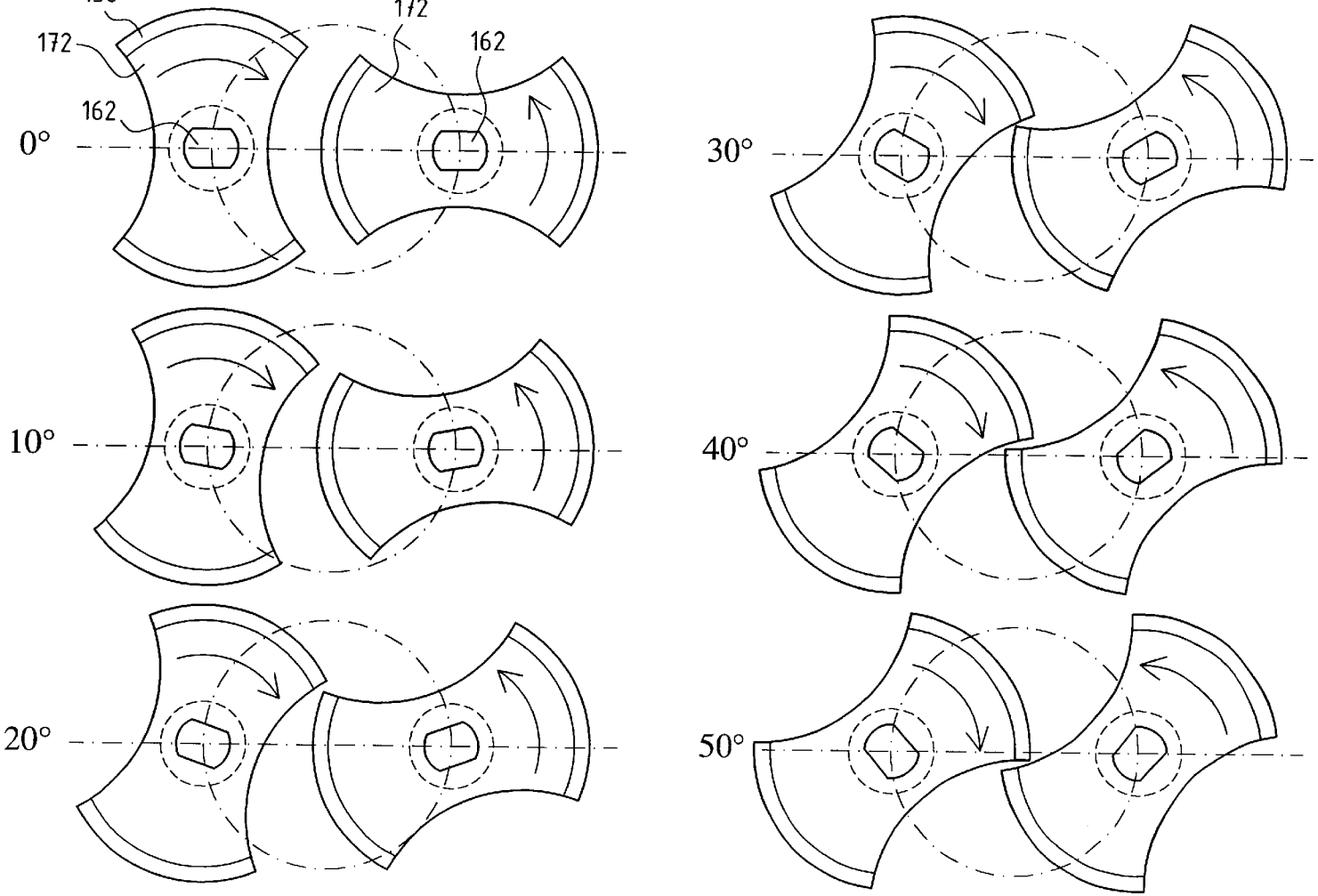
FIG. 24 is a schematic showing the cooperation between the rotations of elongate blades that sweep overlapping areas.
Figure 26:
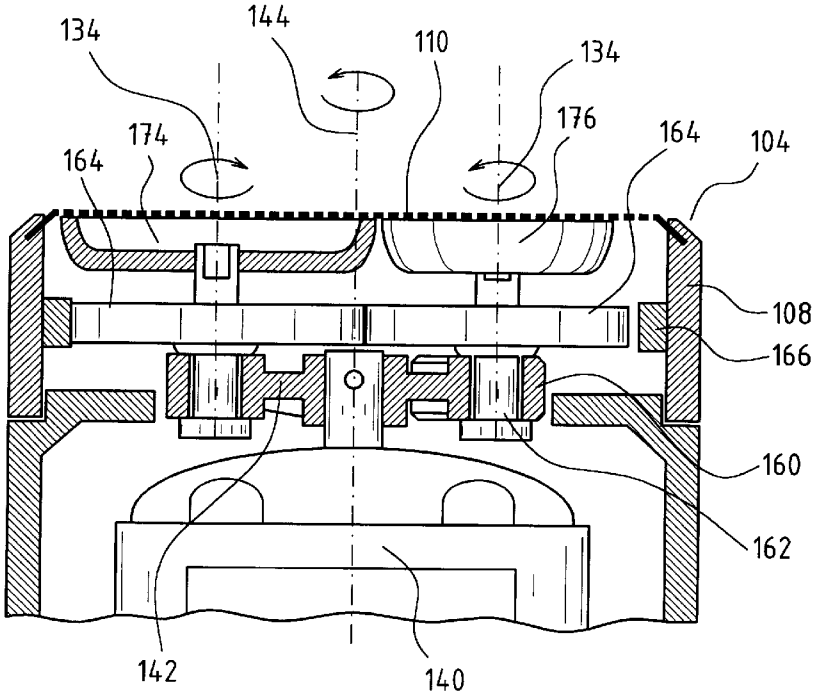
FIG. 26 is a front elevation of the eleventh embodiment of the shaver mechanism, viewed in partial section along 26—26.
Figure 25:
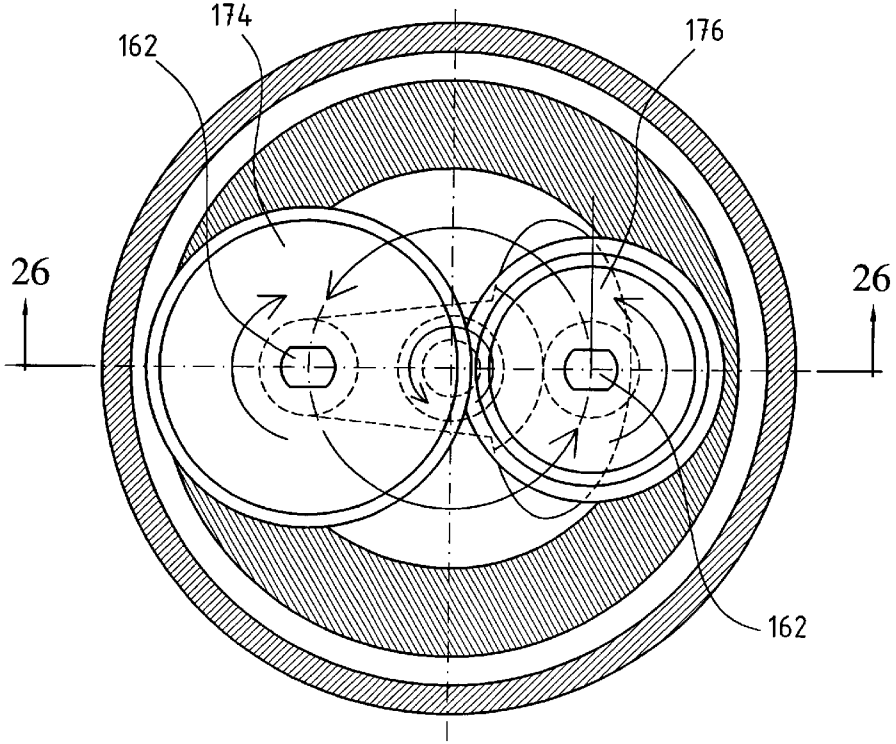
FIG. 25 is a plan view of an eleventh embodiment of the shaver mechanism.
Figure 28:
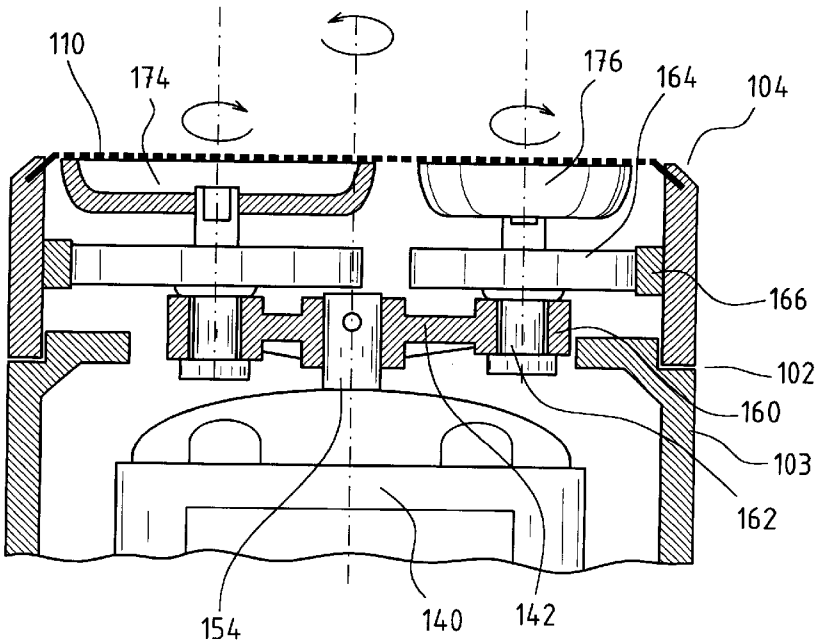
FIG. 28 is a front elevation of the eleventh embodiment of the shaver mechanism, viewed as partially sectioned in an angular manner along 28—28.
Figure 27:
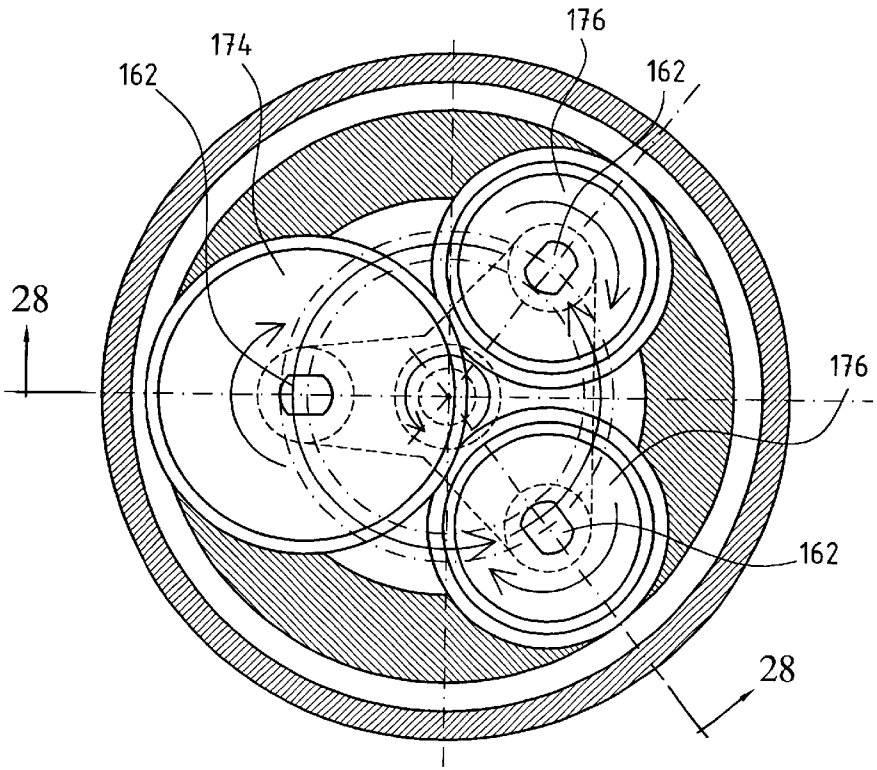
FIG. 27 is a plan view of another version of the eleventh embodiment of the shaver mechanism.

FIGS. 22 and 23 show a tenth embodiment, wherein substantially rectangular elongate blades 171 are provided on a carrier 142 such as that of the first embodiment. The blades 171 differ from the elongate blades 170 in that their knife edges 136 are positioned at the rounded ends rather than along the sides, to provide a cutting action best suited to their orbital movement. The overlapping rotations of the blades 171, combined with their revolution about the primary axis 144 provide that the resultant sweep covers almost the entire contact area 106. Even greater overlap is provided by elongated "bow-tie" shaped blades 172 such as are shown in FIG. 24. This figure depicts how elongate blades can sweep overlapping areas when properly aligned and rotated in synchronization. The blades 172 are shown having moved in successive 10° increments while rotating in opposite directions.

Another means of increasing overlap is shown in an eleventh embodiment of FIGS. 25, 26, 27 and 28, wherein a larger circular blade 174 and one or more smaller circular blades 176 follow orbits around the primary axis. The larger blade 174 is sized to encompass the primary axis 144, so that when the carrier rotates, the sweep of the larger blade 174 is that of the entire circle defined by its outermost point. By contrast, a similar configuration having equally sized blades could not encompass the primary axis 144, which would therefore be outside the sweep area. Somewhat different transmission mechanisms for causing the blades to rotate about their centers are evident between FIGS. 26 and 28.

Figure 30:
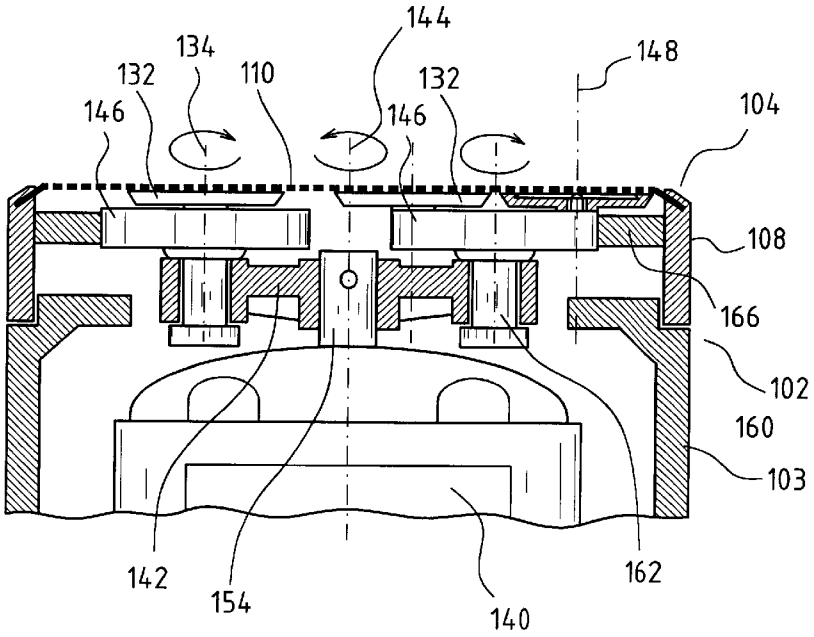
FIG. 30 is a front elevation of the twelfth embodiment of the shaver mechanism, viewed in partial section along 30—30.
Figure 29:
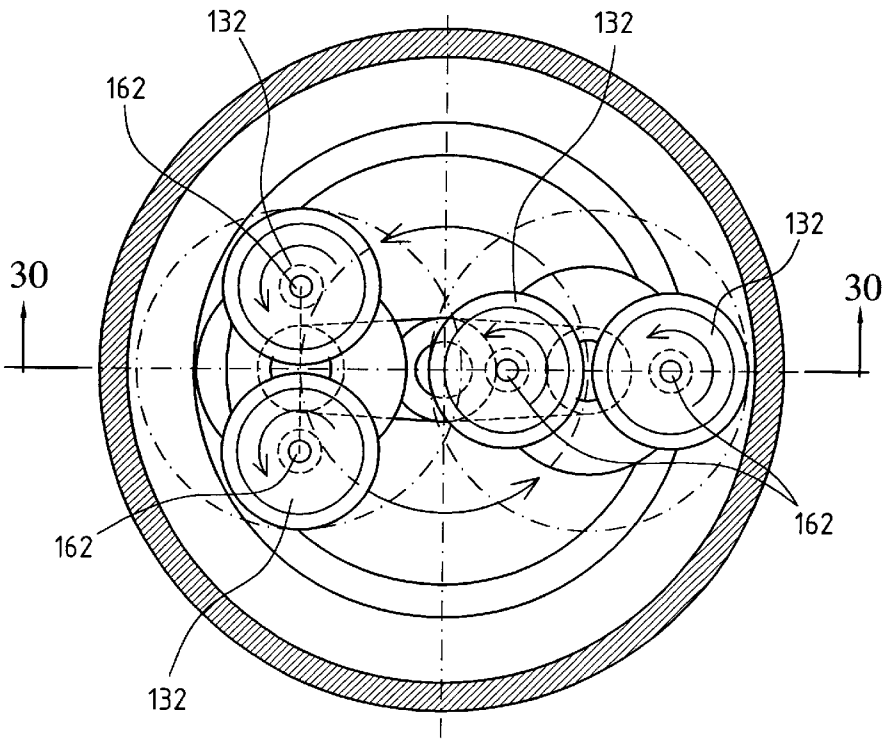
FIG. 29 is a plan view of a twelfth embodiment of the shaver mechanism.

In a twelfth embodiment, exemplified in FIGS. 29 and 30, the primary carrier 142 is connected with the drive axle 154 of the motor 140. Secondary carriers 146 are rotatably attached at points of the primary carrier 142 through which pass corresponding secondary axes 148. Blades 132 are mounted on the secondary carriers 146 and can rotate about corresponding center lines 134. In the example of FIGS. 29 and 30, there are two secondary carriers 146 at the extremities of the primary carrier 142, which is substantially linear, each secondary carrier 146 having two blades 132 at opposed positions relative to the secondary axis. The secondary carriers 146 also act as gears which engage with the gear ring 166, each thus being rotatable about the corresponding secondary axis 148, in response to rotation of the primary carrier 142. In this embodiment, each of the blades 132 describes a complex orbit that periodically intersects the primary axis 144. Each blade 132 is free to rotate about its corresponding center line 134 in response to frictional forces exerted thereon by the screen 110. Each pair of blades thus sweeps an area comparable to that swept by one of the elongate blades 170 or 172 of the tenth embodiment.

Figure 32:
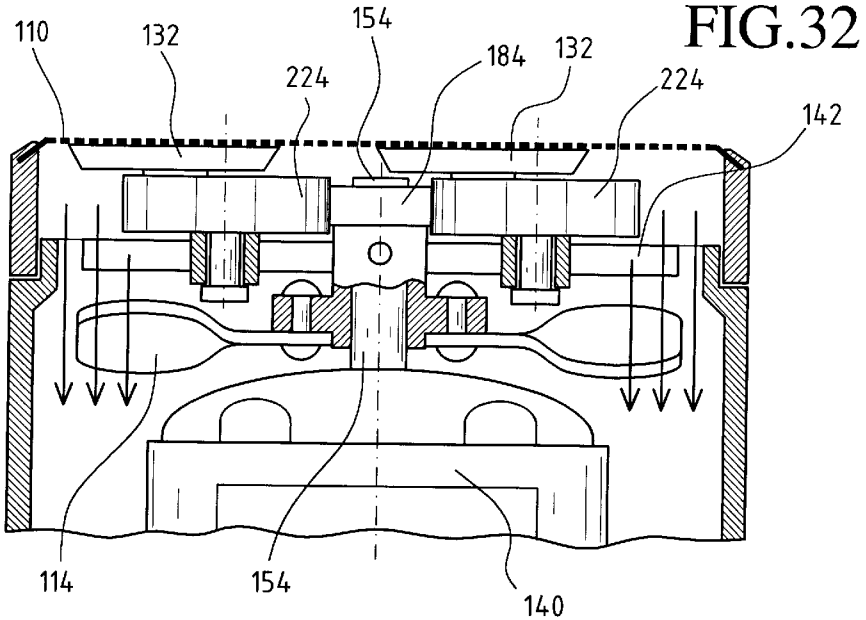
FIG. 32 is an elevation of the thirteenth embodiment of the shaver mechanism, viewed in a partial section taken along the diagonal 32—32.
Figure 33:
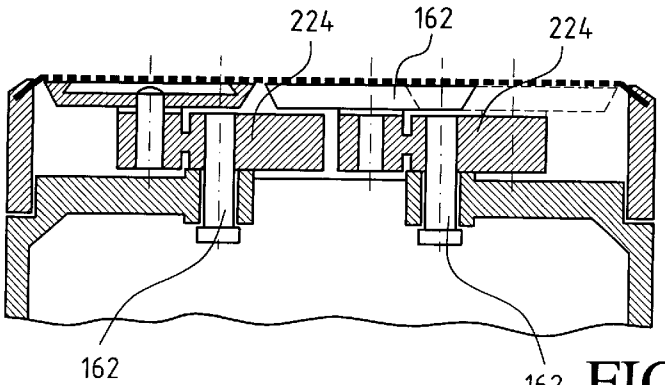
FIG. 33 is a front elevation of the thirteenth embodiment of the shaver mechanism, viewed in a partial section taken along the 33—33.
Figure 31:
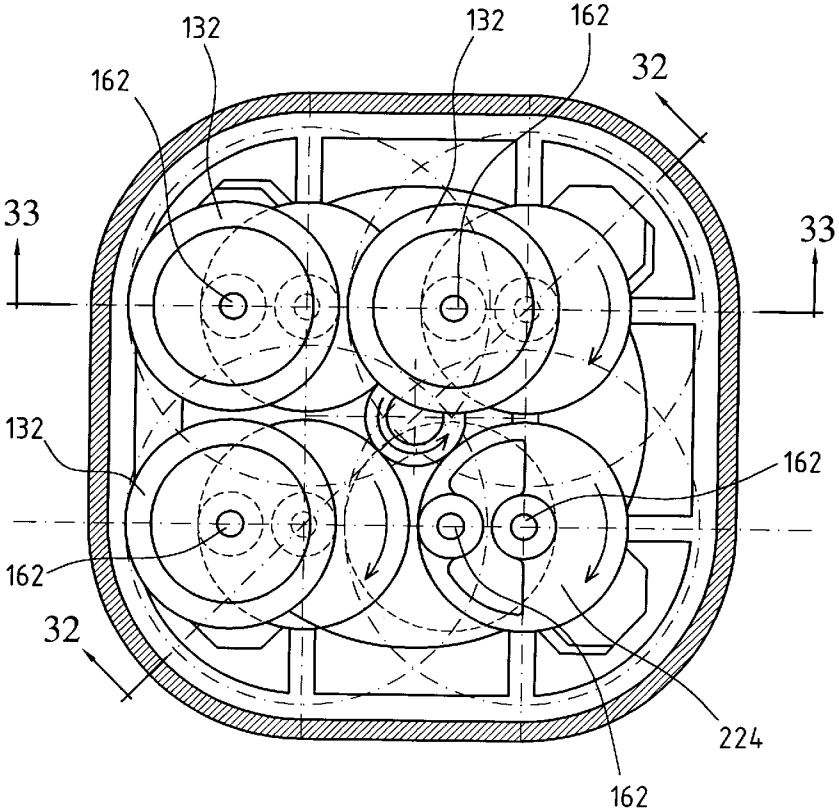
FIG. 31 is a plan view of a thirteenth embodiment of the shaver mechanism.

In a thirteenth embodiment of the invention, exemplified in FIGS. 31, 32 and 33, a toothed carrier member 224 combines the functions of the carrier 142 and the gear wheel 164. The member 224 carries only a single blade 132 and its mass is distributed so as to provide a counterbalance to the blade about the primary axis 144. The blade 132 has a diameter large enough to overlap the primary axis 144. In this example, four carrier members 224 engage with a central gear wheel 184, and are located at equally spaced points about the gear wheel. The center line 134 of each blade 132 can orbit around the secondary axis 148, and with all the carriers aligned in the same direction, the blades 132 can, without interfering with each other, revolve around their secondary axes 148. The combined sweeps of the four blades 132 provide that an area having the substantially the shape of a rounded square is entirely swept. When revolving, the blades 132 can also rotate about their center lines 134 in response to frictional forces exerted thereon by the screen 110.

FIG. 32 also shows a fan 114 which is included to draw air inward from the screen 110, causing shaved hair to be more effectively entrained in the shaving apparatus 100. Such a fan can optionally be included in any other embodiment of the invention.

Figure 35:
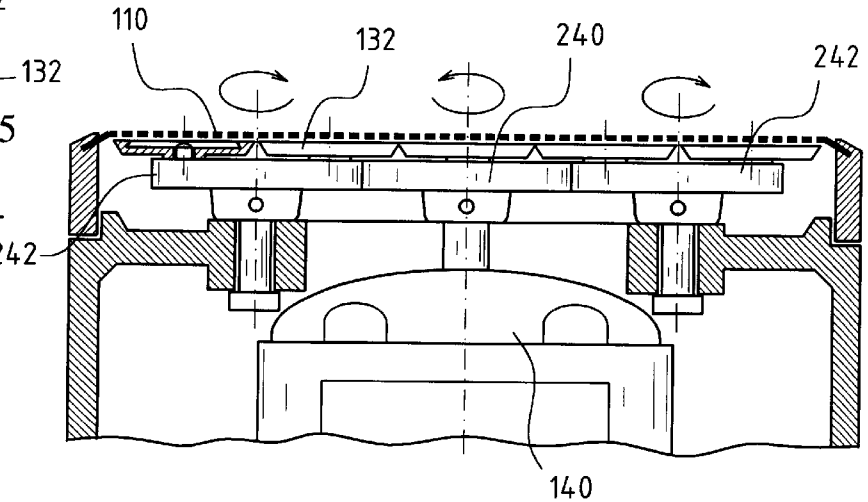
FIG. 35 is a front elevation of the fourteenth embodiment of the shaver mechanism, viewed in a partial section taken along the 35—35.
Figure 34:
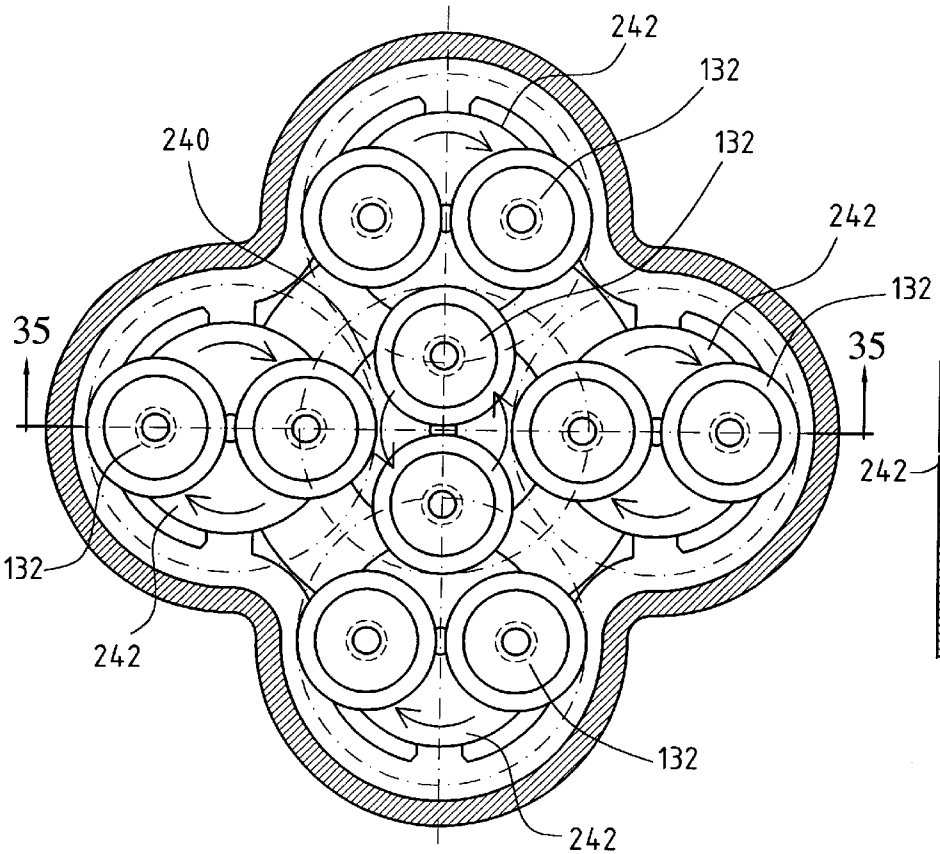
FIG. 34 is a plan view of a fourteenth embodiment of the shaver mechanism.

A fourteenth embodiment is illustrated in FIGS. 34 and 35. In this example, blades 132 are provided in pairs on corresponding carrier gears. The central carrier gear 240 is coaxial with the common primary motor 140, and cooperates with four perimeter carrier gears 242 spaced equally around it, all the gears 240 and 242 being identical so that they rotate at the same speed. Neighboring pairs of blades 132 are aligned so that they can sweep overlapping areas without interfering with each other. In principle, a pattern such as this can be varied, curtailed or extended to include any number of carrier gears and a corresponding number of blades, provided that the requirement that neighboring blades do not interfere with each other is not violated.

Figure 37:
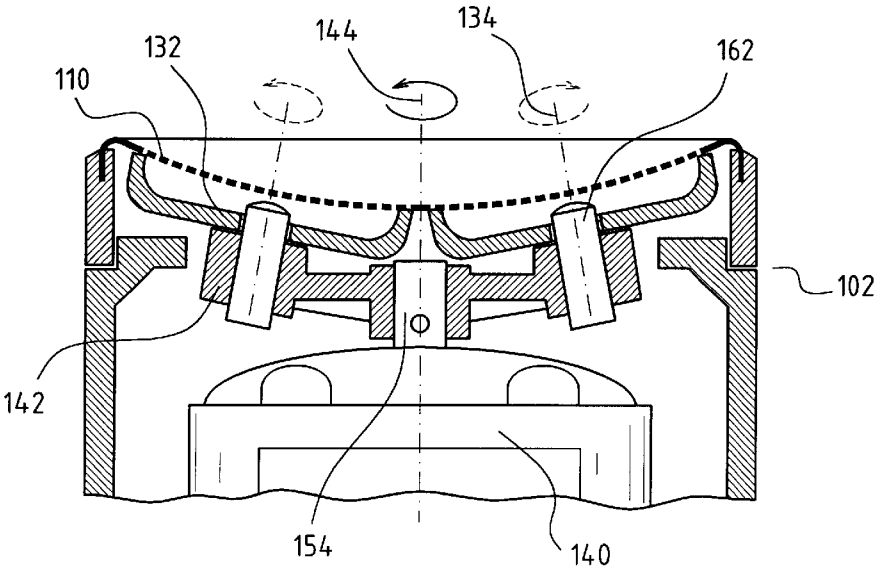
FIG. 37 is a side view in partial section of a sixteenth embodiment of the shaver mechanism.
Figure 36:
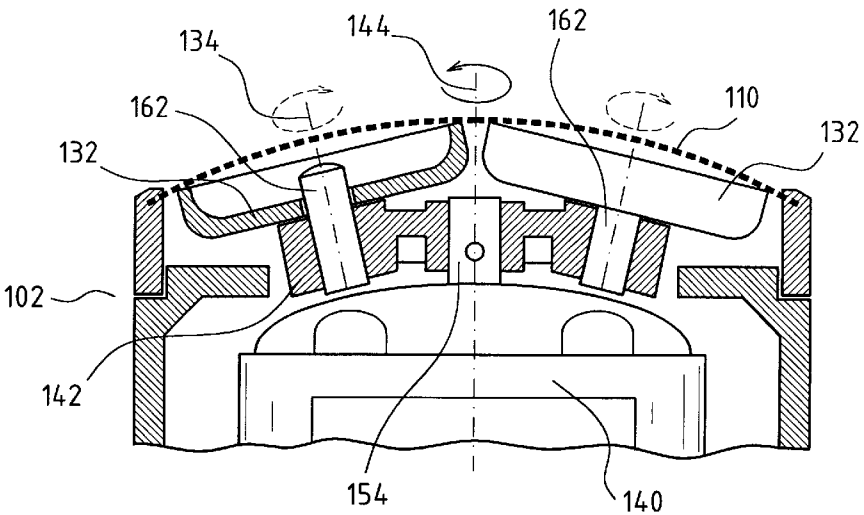
FIG. 36 is a front elevation in partial section of a fifteenth embodiment of the shaver mechanism.

The screen 110 is typically flat, but may optionally be convex, as in a fifteenth embodiment shown in FIG. 36, or concave, as in a sixteenth embodiment shown in FIG. 37. The carrier 142 is accordingly configured so that the knife edges present a proper contact angle with the screen 110. The screen 110 may have a more complex shape which is generally concave but with a convex central portion, to provide optimum stretching of the skin.

Figure 39:
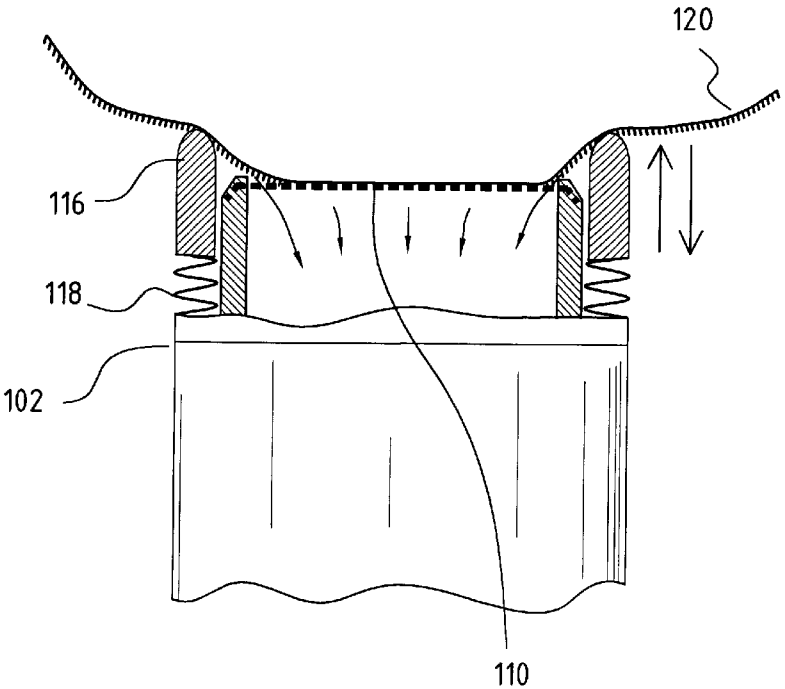
FIG. 39 is a plan view of an eighteenth embodiment of the shaver mechanism.
Figure 38:
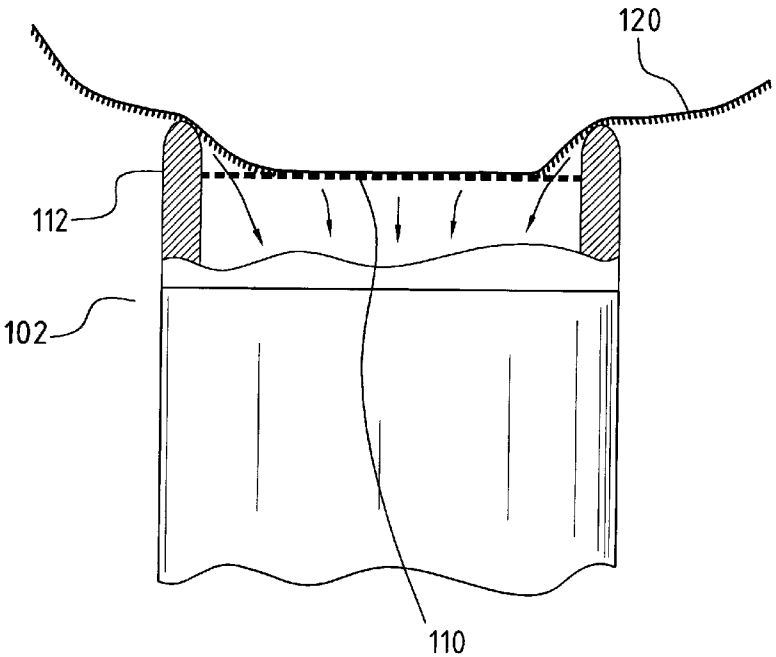
FIG. 38 is a schematic of a seventeenth embodiment of the shaver mechanism.

In a seventeenth embodiment of the invention shown in FIG. 38, the wall 108 of the shaving head 104 has a raised rim 112 about the perimeter of the screen 110. The rim can be of a soft plastic or rubber material that contacts the skin. The fan 114 shown in FIG. 32 is included in this embodiment, although omitted from FIG. 38 for clarity. When rotated the fan can cause the air pressure between the head 104 and the skin 120 to be reduced, so pulling the skin towards the screen 110 and thereby stretching it. While FIG. 32 shows the fan 114 coupled to the same motor as the shaver blades 132, it may optionally be driven by a separate motor. The rim 112 may optionally be in the form of a ring 116 which is movably mounted to the remaining part of the head through a spring 118, as shown in FIG. 39, and so can "float" as the shaver is moved. The ring 116 can optionally be made from a hygienic substance such as solid soap with additives or solid soft foam impregnated with a special gel, which would improve lubricity of the shaver head and condition a user's skin and beard to improve shaving. When close to being exhausted, such a ring can be replaced with a new one.

Figure 40:
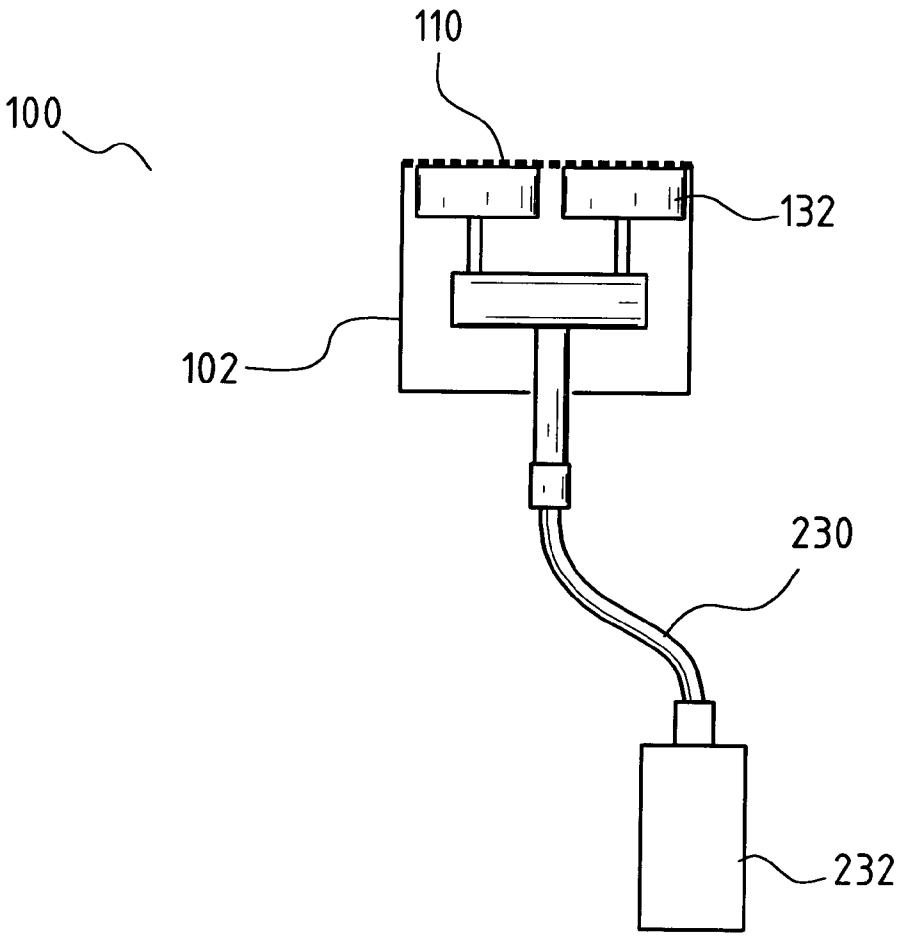
FIG. 40 is an end elevation in partial section of the eighteenth embodiment of the shaver mechanism.

In an eighteenth embodiment of the invention shown in FIG. 40, the shaver 100, instead of having an internal motor, is removably coupled to an external motor. Preferably, the shaver is connected to one end of a flexible transmission coupling 230, the other end of which is operably attached to a stationary motor 232. In this embodiment, the stationary motor 232 may be permanently installed a car, or in private quarters or public washrooms in an hotel, a restaurant, an office building, an aircraft, a train, an ocean liner or other building or vehicle. The shaver 100 might typically be purchased inexpensively at the site of the stationary motor 232 or otherwise at some retail establishment. Such an embodiment would have the advantage of providing an inexpensive shaver that could optionally be disposed of after a number of uses. It would also have the advantage that the user while on an extended trip in several different countries would need to worry about neither different supply voltages for an electric shaver, nor carry a charging device in the case of a cordless electric shaver, since the coupling 230 between the motor 232 and the shaver 100 is mechanical. In this embodiment, the shaver can optionally have a simple revolution counter, which enables the user to gauge when the useful lifetime of the shaver has expired. This embodiment may also have an optional chamber configured to collect and permanently retain the shaved whiskers until the shaver is disposed of.

The blade configurations are not limited to those such as 132, 170, 171 and 172 described herein. In particular, blades can be cup-shaped and can include a variety of openings therein for both functional and decorative purposes. The openings assist in facilitating the collection of shaved hairs in a collection area of the shaving apparatus. Alternatively, empty space inside a cup-shaped blade can be utilized. For example, the space may be used as a receptacle for a hygienic substance such as a solid soap or a cream that will treat the user's hair and skin in the process of shaving.

The shaving head 104 may optionally be configured to engage a pre-existing housing, thereby being capable of replacing a conventional shaving head thereon. For example, a known conventional shaver has three rotary blades disposed in a triangular pattern within a generally triangular shaving head. The head snaps on the shaver housing and each blade engages a corresponding axle. It is contemplated that the inventive shaving head will be configured to snap onto the same housing, and that its blades will operably connect with the axles of the conventional shaver.

While the invention has been described in connection with the preferred embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for shaving hair, comprising:

(a) a housing including a body portion and a shaving head;

(b) a carrier rotatably driven about a primary axis, the carrier having opposite ends;

(c) a cutting blade rotatably mounted in the shaving head to each opposite end of the carrier, each of the cutting blades being rotatable with respect to the carrier about a secondary axis and the cutting blades being selected to provide overlapping sweeps, each blade defining a respective sweep; and (d) a screen that engages with the blades attached to a wall of the housing.

2. The apparatus of claim 1, wherein the blades are identical.

3. The apparatus of claim 1, wherein the sweeps have different areas.

4. The apparatus of claim 1, further comprising a primary motor operably connected to the blades.

5. The apparatus of claim 4, further comprising a secondary motor operably connected to the blades.

6. The apparatus of claim 4, further comprising a plurality of secondary motors operably connected to corresponding blades.

7. The apparatus of claim 4, wherein the motor is internal to the housing.

8. The apparatus of claim 4, wherein the motor is external to the housing.

9. The apparatus of claim 8, wherein the motor is removably connected to the blades by a flexible coupling.

10. The apparatus of claim 8, wherein the housing has a chamber configured to collect and permanently retain shaved whiskers.

11. The apparatus of claim 8, wherein a revolution counter in the housing is operably connected to the blades.

12. The apparatus of claim 1, further comprising a raised rim connected to the wall.

13. The apparatus of claim 12, wherein the rim is movably connected to the wall.

14. The apparatus of claim 12, wherein the rim comprises a hygienic substance that can be applied to a user's skin.

15. The apparatus of claim 1, further comprising a fan operably connected to the cutting blades to create an inward airflow.

16. The apparatus of claim 1, wherein a first one of said cutting blades rotates in a first direction and a second one of said cutting blades rotates in the opposite direction.

17. An apparatus for shaving hair, comprising:

(a) a housing;

(b) a plurality of cutting blades within the housing, each rotatable about a different secondary axis, each secondary axis capable of orbiting around a primary axis;

(c) means for driving each secondary axis in an orbital movement about the primary axis; and (d) a screen attached to a wall of the housing and also engaging the blades.

18. The apparatus of claim 17, wherein the orbital movement is circular.

19. The apparatus of claim 17, wherein said means is arranged for driving each secondary axis in a non-circular orbit about the primary axis.

20. The apparatus of claim 17, wherein the orbital movement of each secondary axis is defined by its revolution about the last member of a series of axes, each of which can revolve about any immediate predecessor, the first member of the series being the primary axis.

21. The apparatus of claim 20, wherein the series has one member.

22. The apparatus of claim 20, wherein the series has two members.

23. The apparatus of claim 20, wherein the number of blades associated with the series of axes is two.

24. The apparatus of claim 20, wherein the number of blades associated with the series of axes is three.

25. The apparatus of claim 20, further comprising a common motor operably connected to the blades to provide their rotation and orbital movement.

26. The apparatus of claim 25, wherein the motor is internal to the housing.

27. The apparatus of claim 25, wherein the motor is external to the housing.

28. The apparatus of claim 27, wherein the motor is removably connected to the blades by a flexible coupling.

29. The apparatus of claim 20, further comprising:

(a) a first common motor operably connected to the blades to provide their rotation; and (b) a second common motor operably connected to the blades to provide their orbital movement.

30. The apparatus of claim 20, further comprising:

(a) a common primary motor that provides the orbital movement of the blades, (b) a plurality of secondary motors, each motor being operably connected to a corresponding blade and providing the rotation of that blade.

31. The apparatus of claim 17, further comprising a plurality of gears, each gear operably connecting a corresponding blade to the driving means and each gear also rotating its corresponding blade.

32. The apparatus of claim 17, wherein each blade is freely rotated by frictional forces exerted thereon by the screen during the course of the secondary axis being driven in an orbit about the primary axis.

33. The apparatus of claim 17, wherein the screen is flat.

34. The apparatus of claim 17, wherein the screen is convex.

35. The apparatus of claim 17, wherein the screen is concave.

36. The apparatus of claim 17, having a brim configured to hold a hygienic substance and apply it to a user's skin.

37. An apparatus for shaving, comprising:

(a) a housing;

(b) a plurality of carriers rotatably mounted to the housing, each carrier being rotatable about a primary axis and each carrier defining a rotation area, the rotation areas of neighboring carriers overlapping; and (c) a plurality of blades rotatably mounted to each carrier, each blade being rotatable about a secondary axis with respect to its carrier and each blade having a sweep defined by a combination of its own rotation and the rotation area of the respective carrier.

38. The apparatus of claim 37, wherein each carrier has two similar blades.

39. The apparatus of claim 37, wherein each carrier has two dissimilar blades.

40. The apparatus of claim 37, wherein each carrier has three identical blades.

41. The apparatus of claim 37, wherein each carrier rotates around a stationary axis.

42. The apparatus of claim 37, wherein each carrier rotates around a revolving axis.

43. An apparatus for shaving, comprising:

(a) a housing;

(b) a carrier rotatably mounted to the housing, (c) a plurality of swing arms, each having a near extremity pivotally connected with the carrier;

(d) a gear mounted to a far extremity of each swing arm so that it can rotate about a center line; and (e) a blade mounted to each gear and rotatable therewith about the same center line so that when the carrier rotates, the swing arms are outwardly urged by centrifugal force until the gears engage with a gear ring, the blades then having an orbital movement defined by the shape of the gear ring while rotating about their center lines.

* * * * *

UNITED STATES PATENT AND TRADEMARK OFFICE

CERTIFICATE OF CORRECTION

PATENT NO. : 6,584,691 B1
DATED : July 1, 2003
INVENTOR(S) : Gerasimov et al.

It is certified that error appears in the above-identified patent and that said Letters Patent is hereby corrected as shown below:

Title page,
Item [73], Assignee, please add -- Ideation International, Southfield, MI (US) --.

Signed and Sealed this

Twentieth Day of April, 2004

JON W. DUDAS
*Acting Director of the United States Patent and Trademark Office*